US007371497B2

(12) United States Patent
Toda et al.

(10) Patent No.: US 7,371,497 B2
(45) Date of Patent: May 13, 2008

(54) ELECTROPHOTOGRAPHIC IMAGE FORMING METHOD

(75) Inventors: Naohiro Toda, Yokohama (JP); Tatsuya Niimi, Numazu (JP)

(73) Assignee: Ricoh Company Ltd., Tokyo (JP)

( * ) Notice: Subject to any disclaimer, the term of this patent is extended or adjusted under 35 U.S.C. 154(b) by 108 days.

(21) Appl. No.: 11/264,102

(22) Filed: Nov. 2, 2005

(65) Prior Publication Data

US 2006/0105255 A1 May 18, 2006

Related U.S. Application Data

(62) Division of application No. 10/665,155, filed on Sep. 22, 2003, now Pat. No. 7,029,810.

(30) Foreign Application Priority Data

Sep. 20, 2002 (JP) ..... 2002-274473

(51) Int. Cl.
*G03G 13/16* (2006.01)

(52) U.S. Cl. ..... 430/125.5; 430/59.5

(58) Field of Classification Search ..... 430/59.5, 430/58.7, 133, 78, 125.5
See application file for complete search history.

(56) References Cited

U.S. PATENT DOCUMENTS

| | | | | |
|---|---|---|---|---|
| 4,898,799 | A | 2/1990 | Fujimaki et al. | |
| 5,595,846 | A * | 1/1997 | Shigematsu et al. | 430/59.4 |
| 5,677,094 | A | 10/1997 | Umeda et al. | |
| 5,753,395 | A | 5/1998 | Kinoshita et al. | |
| 5,804,343 | A | 9/1998 | Umeda et al. | |
| 5,853,935 | A | 12/1998 | Suzuki et al. | |
| 5,871,876 | A | 2/1999 | Ikuno et al. | |
| 6,087,055 | A | 7/2000 | Niimi | |
| 6,132,911 | A | 10/2000 | Niimi | |
| 6,218,533 | B1 | 4/2001 | Niimi | |
| 6,253,037 | B1 | 6/2001 | Park | |
| 6,268,096 | B1 | 7/2001 | Nukada et al. | |
| 6,270,936 | B1 * | 8/2001 | Tanaka et al. | 430/59.5 |
| 6,326,112 | B1 | 12/2001 | Tamura et al. | |
| 6,516,169 | B2 | 2/2003 | Niimi et al. | |
| 6,558,863 | B2 | 5/2003 | Rokutanzono et al. | |
| 6,562,531 | B2 * | 5/2003 | Niimi | 430/66 |
| 6,573,016 | B2 | 6/2003 | Kami et al. | |
| 6,576,388 | B2 | 6/2003 | Sakon et al. | |
| 6,641,964 | B2 | 11/2003 | Ikuno et al. | |
| 7,186,490 | B1 * | 3/2007 | Niimi et al. | 430/78 |
| 2004/0120730 | A1 | 6/2004 | Niimi et al. | |

FOREIGN PATENT DOCUMENTS

| | | |
|---|---|---|
| JP | 61-239248 | 10/1986 |
| JP | 64-17066 | 1/1989 |
| JP | 1-299874 | 12/1989 |
| JP | 2-8256 | 1/1990 |
| JP | 3-109406 | 5/1991 |
| JP | 3-255456 | 11/1991 |
| JP | 3-269064 | 11/1991 |
| JP | 4-191745 | 7/1992 |
| JP | 5-94049 | 4/1993 |
| JP | 5-113688 | 5/1993 |
| JP | 6-293769 | 10/1994 |
| JP | 7-302002 | 11/1995 |
| JP | 10-186886 | 7/1998 |
| JP | 10-326023 | 12/1998 |
| JP | 11-5919 | 1/1999 |
| JP | 2000-75572 | 3/2000 |
| JP | 2000-206723 | 7/2000 |
| JP | 2001-19871 | 1/2001 |
| JP | 2001-34001 | 2/2001 |
| JP | 2001-305888 | 11/2001 |
| JP | 2001-356506 | 12/2001 |
| JP | 2002-148904 | 5/2002 |
| JP | 2002-148905 | 5/2002 |

OTHER PUBLICATIONS

USPTO translation of JP 11-140337 Published May 25, 1999.*
Handbook of imaging materials A. Diamond printed 1991, 2 pages.*

* cited by examiner

*Primary Examiner*—John L Goodrow
(74) *Attorney, Agent, or Firm*—Oblon, Spivak, McClelland, Maier & Neustadt, P.C.

(57) ABSTRACT

An electrophotographic image forming apparatus comprising:

an electrophotographic photoreceptor comprising:
an electroconductive substrate;
a charge generation layer; and
a charge transport layer in this order, a charger;

an irradiator;

an image developer; and a transferer applying an electric current not less than 65 μA to the electrophotographic photoreceptor, wherein the charge generation layer comprises titanylphthalocyanine crystals having a CuKα 1.542 Å X-ray diffraction spectrum having plural diffraction peaks, wherein a maximum diffraction peak is observed at a Bragg (2θ) angle of 27.2°; main peaks are observed at 9.4°, 9.6° and 24.0°; and a minimum diffraction peak is observed at 7.3°; and no diffraction peak is observed at an angle greater than 7.3° and less than 9.4°, wherein said angles may vary by ±0.2° and the minimum interval where no peak is observed between required peaks at 7.3 and 9.4 is 2.0 degrees absolute or more.

10 Claims, 14 Drawing Sheets

ELECTROPHOTOGRAPHIC IMAGE FORMING METHOD

This application is a Divisional application of U.S. application Ser. No. 10/665,155, filed on Sep. 22, 2003, now allowed.

BACKGROUND OF THE INVENTION

1. Field of the Invention

The present invention relates to an electrophotographic image forming apparatus, and more particularly to an electrophotographic image forming apparatus using an electrophotographic photoreceptor formed of a charge transport layer overlying a charge generation layer and including at least a specific titanylphthalocyanine crystal, wherein a toner image is transferred with the application of not less than a specific current.

2. Discussion of the Background

Recently, information processing system apparatuses using an electrophotographic image forming method have been significantly progressed. Particularly, impressive improvements in print quality and reliability have been made in optical printers which optically record information by converting the information into a digital signal. This digital recording technology is applied not only to printers but also to conventional copiers, and so-called digital copiers have been developed. In addition, it has been predicted that the demand for copiers including digital recording technology in addition to conventional analog copying technology will increasingly grow because various information processing functions have been added thereto. Furthermore, because of the popularization of personal computers and the improvement of the performance thereof, digital color printers producing color images and documents have also rapidly progressed.

Recently, printers and copiers have been required to be smaller and to have high-speed printing capability. Accordingly, photoreceptors need to be smaller and rotate at a high speed. Therefore, an electrostatic latent image has to be developed to a toner image in a short time after the photoreceptor is irradiated, and thus deterioration of the electrical properties of the photoreceptor are accelerated because of repeated use due to an increase of the number of revolutions thereof.

To solve this problem, it is known that a highly sensitive titanylphthalocyanine crystal having at least a maximum diffraction peak at of a Bragg (2θ) angle of 27.2±0.2° when irradiated with a specific X-ray of CuKα having a wavelength 1.542 Å can be used as a charge generation material.

However, this crystal form is not stable as a crystal and easily changes due to mechanical stresses such as dispersion, and due to thermal stresses. The crystal form after the transition has substantially lower sensitivity compared to the original crystal form, and when a part of the crystal changes in form, sufficient photocarrier generation function is not realized. Furthermore, after repeated use of the photoreceptor, particularly after the application of a reverse charge by a transferer, the accelerated deterioration of the chargeability of the photoreceptor and abnormal images called background fouling tend to be produced.

In addition, because the frequency of image production significantly increases, it is essential that an apparatus produces high quality images. To achieve this, an electrostatic latent image having a high density has to be formed on the photoreceptor by a charger and an irradiator, subsequently the electrostatic latent image has to be faithfully developed by an image developer to form a toner image on the photoreceptor, and lastly the toner image on the photoreceptor has to be precisely transferred onto a transfer sheet. To achieve these, a method of forming an electrostatic latent image by high density writing with a small diameter beam as the irradiator, a method of forming a toner image which is faithful to the electrostatic latent image on the photoreceptor with a toner having a small particle diameter, and a method of faithfully transferring the toner image on the photoreceptor onto a transfer sheet by increasing the gap electric field strength to increase the transfer efficiency are available. Increasing the gap electric field strength particularly accelerates the deterioration of the electrical properties of a photoreceptor, causing abnormal images called background fouling, as mentioned above when the photoreceptor using the above-mentioned titanylphthalocyanine crystal having at least a maximum diffraction peak at of a Bragg (2θ) angle of 27.2±0.2° when irradiated with a specific X-ray of CuKα having a wavelength 1.542 Å, is repeatedly used.

On the other hand, the charge transport layer transporting a charge mainly includes a charge transport material and a binder resin, and is typically formed by coating a coating liquid in which these materials are dissolved or dispersed in a solvent. Specific examples of the solvent include halide solvents such as dichloromethane and chloroform having good solubility and applicability.

Lately, concern about environmental problems is growing and a photoreceptor using a non-halide solvent which does not seriously affect human bodies and the environment is desired. However, when a photoreceptor is formed using a charge transport layer coating liquid including this non-halide solvent, the optical attenuation properties of the photoreceptor deteriorate at a low electric field strength and the residual potential thereof increases. Particularly, this phenomenon noticeably occurs when a photoreceptor using the titanylphthalocyanine crystal showing uniquely a high sensitivity for a wavelength range of from 600 to 780 nm, stably emitted by the present LD and LED, and having at least a maximum diffraction peak at of a Bragg (2θ) angle of 27.2±0.2° when irradiated with a specific X-ray of CuKα having a wavelength 1.542 Å, is used without taking advantage of its primary properties as a charge generation material.

In addition, various methods of using non-halide solvents have been studied, and for example, Japanese Laid-Open Patent Publication No. 10-326023 discloses a method of using a dioxolane compound as an organic solvent excluding a halide. Furthermore, Japanese Laid-Open Patent Publications Nos. disclose methods of including a specific antioxidant or ultraviolet absorbent into a cyclic ether solvent such as tetrahydrofuran. However, even these methods do not have sufficient effect on the above-mentioned defects, or instead the additives deteriorate the sensitivity of the photoreceptor.

For these reasons, a need exists for an electrophotographic photoreceptor having a good optical attenuance, an electrophotographic image forming apparatus and a process cartridge for electrophotography using the electrophotographic photoreceptor, even when the titanylphthalocyanine having a specific high sensitivity is used as a charge generation material and a non-halide solvent is used for a charge transport layer coating liquid.

SUMMARY OF THE INVENTION

Accordingly, an object of the present invention is to provide an electrophotographic image forming apparatus which stably producing high-resolution images without produces abnormal images when repeatedly used at a high speed, specifically by eradicating the electrical deterioration of the photoreceptor due to a reverse charge in a transferee.

Another object of the present invention is to provide an elect rophotographicimage forming apparatus which maintains the specific high sensitivity of the titanylphthalocyanine even when a non-halide solvent is used for the charge transport layer coating liquid.

Briefly these objects and other objects of the present invention as hereinafter will become more readily apparent, can be attained by an electrophotographic image forming apparatus including at least an electrophotographic photoreceptor which includes at least an electroconductive substrate; a charge generation layer overlying the substrate; a charge transport layer overlying the charge generation layer, a charger charging the electrophotographic photoreceptor; an irradiator irradiating the electrophotographic photoreceptor to form an electrostatic latent image thereon; an image developer developing the electrostatic latent image with a developer including at least a toner to form a toner image on the electrophotographic photoreceptor; and a transferer transferring the toner image onto a transfer sheet, wherein the transferer applies an electrical current of not less than 65 μA to the electrophotographic photoreceptor, and wherein the charge generation layer includes a titanylphthalocyanine crystal having a CuKα 1.542 Å X-ray diffraction spectrum including plural diffraction peaks, wherein a maximum diffraction peak is observed at a Bragg (2θ) angle of 27.2° main peaks are observed at 9.4°, 9.6° and 24.0°; and a minimum diffraction peak is observed at 7.3°; and no diffraction peak is observed at an angle greater than 7.3° and less than 9.4°, wherein said angles may vary by ±0.2° and the minimum interval where no peak is observed between required peaks at 7.3 and 9.4 is 2.0 degrees absolute or more. The transfer current of 65 μA is larger than a typical transfer current, and is more effectively used in a high-speed digital electrophotographic image forming apparatus, preferably a high-speed digital electrophotographic image forming apparatus having a linear speed not less than 200 mm/sec. A detailed reason for the effect of the present invention has not been clarified, but is believed to come from the high chemical stability of the titanylphthalocyanine crystal of the present invention.

Constant current control methods are known for controlling the transfer current and are disclosed in Japanese Laid-Open Patent Publications Nos. 7-302002, 10-186886, 2000-75572 and 2001-305888. Specific examples of constant current control methods include a feed-back control method of controlling the difference between the output current from an electrical source (electrical power supply such as a high-voltage electrical source) supplying a charge to a transfer member and a current flow in a substrate supporting a transfer belt, etc. The difference is regarded as the transfer current applied to a photoreceptor. However, objects of the publications are decreasing the problems caused by a large current applied to a photoreceptor and the upper limits thereof are at most 50 μA. This is because a reverse bias for the transfer causes electrostatic deterioration of the photoreceptor as mentioned above. Although effective means for controlling the process are available, effective photoreceptors taking advantage of the means are not available. Therefore, the toner still remains on the photoreceptor after being transferred, and a toner image faithful to an electrostatic latent image thereon cannot be transferred. However, the present invention solves these problems.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of -the present invention will be more fully appreciated as the same become better understood from the detailed description when considered in connection with the accompanying drawings in which like reference characters designate like corresponding parts throughout.

DETAILED DESCRIPTION OF THE INVENTION

Figure 1:
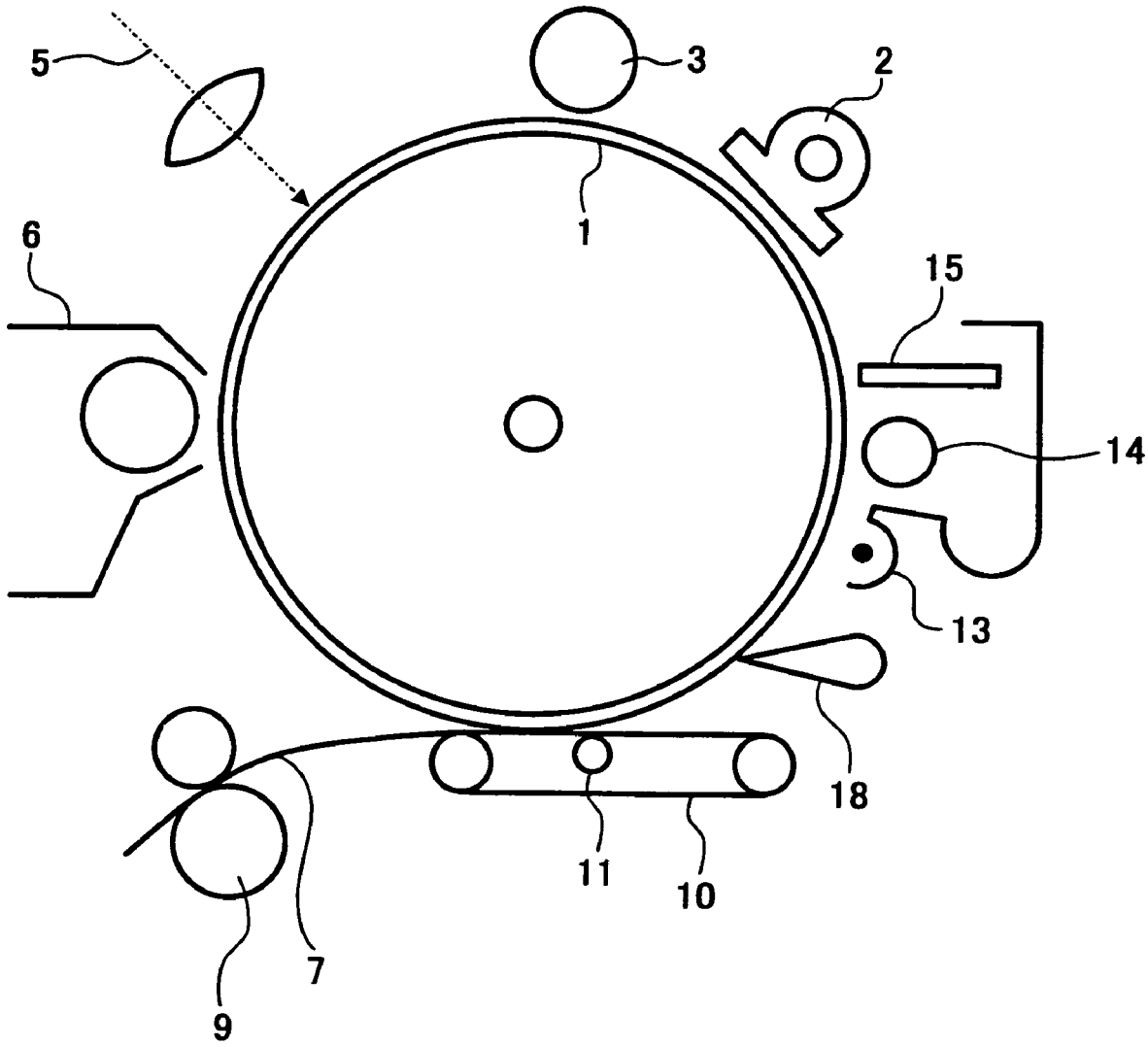
FIG. 1 is a schematic view for explaining the electrophotographic image forming process and apparatus of the present invention.

Generally, the present invention provides an electrophotographic image forming apparatus which stably produces high-resolution images without producing abnormal images when repeatedly used at a high speed, specifically by eradicating the electrical deterioration of the photoreceptor due to a reverse charge in a transferer, and maintaining the specific high sensitivity of the titanylphthalocyanine even when a non-halide solvent is used for a charge transport layer coating liquid.

First, the electrophotographic image forming apparatus will be explained in detail, referring to the drawings.

FIG. 1 is a schematic view illustrating a cross section of an embodiment of an electrophotographic image forming apparatus for explaining the electrophotographic image forming process of the present invention. Modified embodiments as shown below are included in the present invention.

In FIG. 1, a photoreceptor 1 is formed by a photosensitive layer located overlying an electroconductive substrate, which includes at least a charge generation layer and a charge transport layer, wherein the charge generation layer includes a titanylphthalocyanine crystal having a CuKα 1.542 Å X-ray diffraction spectrum including plural diffraction peaks, wherein a maximum diffraction peak is observed at a Bragg (2θ) angle of 27.2°; main peaks are observed at 9.4°, 9.6° and 24.0°; and a minimum diffraction peak is observed at 7.3°; and no diffraction peak is observed at an angle greater than 7.3° and less than 9.4°, wherein said angles may vary by ±0.2° and the minimum interval where no peak is observed between required peaks at 7.3 and 9.4 is 2.0 degrees absolute or more. The photoreceptor 1 has the shape of a drum, and may have the shape of a sheet or an endless belt. Known chargers such as corotrons, scorotrons and solid state chargers can be used for a charging roller 3. A transfer charger or roller can be used for a transfer belt 10, and a contact type transfer belt or roller generating less ozone is preferably used. Either a fixed voltage method or a fixed current method can be used as an electrical voltage or current application method in transferring, and the fixed current method capable of constantly maintaining a transfer charge amount and having good stability is preferably used.

As a charger, particularly at least a charging member mainly used for charging the photoreceptor (in FIG. 1, a charging roller 3) is preferably a contact charging member or a closely located non-contact charging member. The contact charging member and non-contact closely located charging member have the advantages of having high charging efficiency, generating less ozone, being capable of being reduced in size, etc.

The contact charging member is a member contacting its surface to that of the photoreceptor, and has the shape of a charging roller, charging blade and a charging brush. Particularly, charging rollers and brushes are preferably used.

The closely located charging member is a non-contact member such that. there is a gap of not greater than 200 μm between the surfaces of the photoreceptor and the charging member. When the gap is too large, the photoreceptor is unstably charged. When the gap is too small, residual toner on the photoreceptor contaminates the surface of the charging member. Therefore, the gap is preferably from 10 to 200 μm, and more preferably from 10 to 100 μm. Depending on the length of the gap, known charge wire type chargers such as corotrons and scorotrons and the contact charging members such as charging rollers, charging brushes and charging blades may be separately used.

Such closely located charging members have the advantages of having less surface contamination with a toner, less surface abrasion, less physical and chemical surf ace deterioration, high durability, etc. The contact charging member deteriorates its chargeability or unevenly charges a photoreceptor in repeated use in an electrophotographic image forming apparatus due to the problems mentioned above. To avoid such defective charging, the applied voltage to the charging member is increased in accordance with the deterioration of its chargeability. In such a case, the charging hazard on a photoreceptor increases, resulting in deterioration of the durability of the photoreceptor and the production of abnormal images. Furthermore, the durability of the charging member deteriorates in accordance with the increase of the applied voltage thereto. However, a non-contact charging member having high durability and charging stability improves durability and stability not only of the photoreceptor but also of an image forming apparatus using the non-contact charging member.

Figure 2:
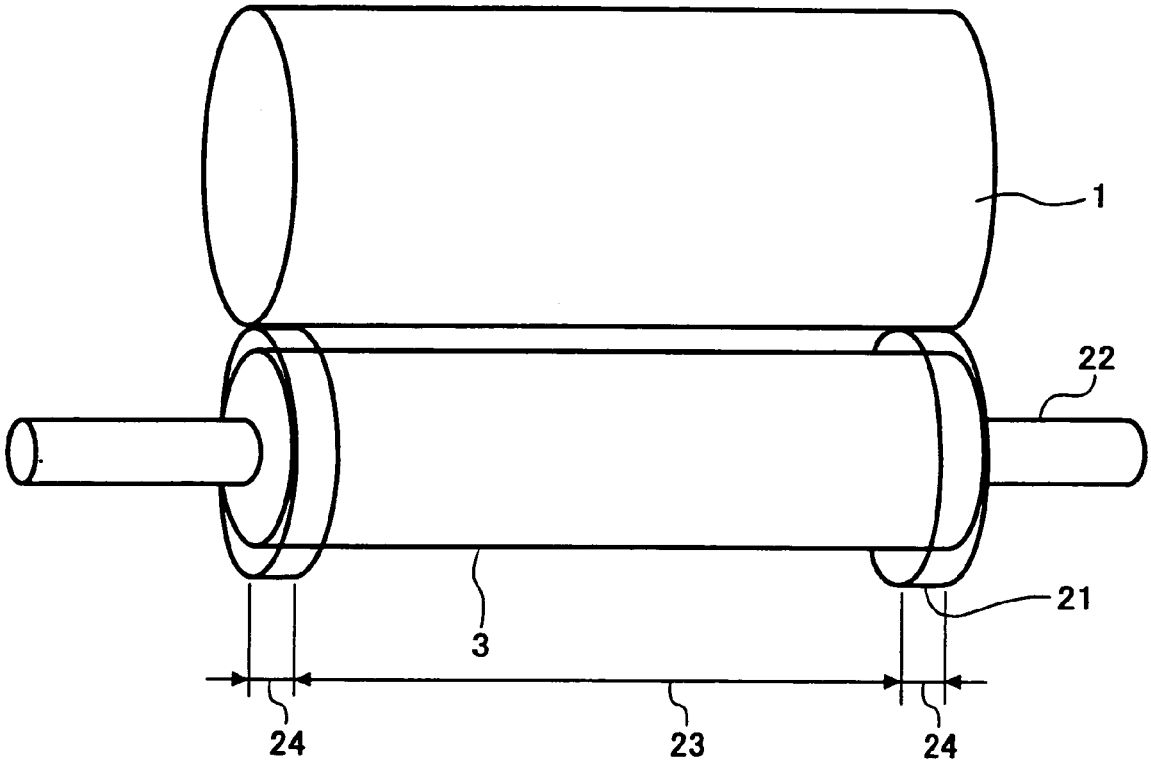
FIG. 2 is a schematic view illustrating an embodiment of the charger located closely to the photoreceptor, which has gap forming members for use in the present invention.

The charging member located closely to a photoreceptor for use in the present invention may have any shape provided that the gap from the photoreceptor can be properly controlled. For example, rotation axes of the photoreceptor and charging member may be fixed mechanically such that there is a proper gap. Simple methods of stably maintaining the gap include a method of using a charging roller having a gap forming member at both non-image forming ends thereof, which only contact the surface of photoreceptor such that the image forming area thereof does not contact the member, or a method of locating the gap forming members at both non-image forming ends of the photoreceptor, which only contact the surface of the charging member such that the image forming area does not contact the charging member. Particularly, the methods disclosed in Japanese Laid-Open Patent Publications Nos. 2002-148904 and 2002-148905 are preferably used. An embodiment of the charger located closely to the photoreceptor, which has a gap forming member is shown in FIG. 2. This is preferably used because of having the advantages of having a high charging efficiency, generating less ozone, being capable of being reduced in size, having no toner contamination, having no mechanical abrasion due to contacts, etc.

It is preferable that a DC voltage overlapped with an AC voltage is applied to the photoreceptor to reduce uneven charging. Particularly, in the tandem-type full-color image forming apparatus, the uneven charging causes a large problem in the deterioration of color balance (color reproducibility) in addition to the uneven density of halftone images which occur in a monochrome image forming apparatus. Overlapping an AC voltage with a DC voltage greatly improves the problem. However, when the properties of the AC voltage such as frequencies and peak voltages are too large, the hazard to the photoreceptor becomes large, which occasionally accelerates the deterioration of the photoreceptor. Therefore, the AC voltage overlapping has to be minimized.

The frequency of the AC voltage varies according to the linear speed of the photoreceptor, etc., and is preferably not less than 3 kHz, and more preferably not less than 2 kHz. As for a voltage between peaks, when the relationship between the application voltage to a charging member and the charge potential of a photoreceptor is plotted, the photoreceptor has an uncharged area although a voltage is applied thereto, and the photoreceptor is not charged until it has a certain build-up potential. The most suitable voltage between peaks is about twice as much as the potential, i.e., usually from about 1,200 to 1,500 V. However, when a photoreceptor has low chargeability or quite a large linear speed, the voltage between peaks occasionally falls below twice as much as the potential. To the contrary, when a photoreceptor has good chargeability, the photoreceptor occasionally shows sufficient potential stability even with a voltage between peaks which is not greater than twice as much as the potential. Therefore, the voltage between peaks is preferably not greater than three times, and more preferably twice as much as the build-up potential. When the voltage between peaks is replaced with an absolute voltage, it is preferably not greater than 3 kV, more preferably not greater than 2 kV, and much more preferably 1.5 kV.

A light source such as a laser emitting diode (LED), a laser diode (LD) and an electroluminescence (EL) having a high brightness is used for an irradiator 5.

Particularly, laser emitting diodes (LEDs) and laser diodes (LDs) having a high irradiating energy and a long wavelength of from 600 to 800 nm are preferably used for the phthalocyanine pigment having a specific crystal form and high sensitivity of the present invention.

A developing unit 6 is capable of complying with standard development and reverse development according to the polarity of the toner used. The standard development is performed when the toner has a reverse polarity compared to that of the photoreceptor. An electrostatic latent image is developed when a toner having the same polarity is used. The reverse developing method for developing a written part with a toner is advantageous in improving the longevity of recent digital light sources, because the image area ratio is generally low, although the longevity depends on the light sources used. In addition, both one-component developer including only a toner and two-component developer including a toner and a carrier can be used in the developing unit.

Two methods are available for transferring a toner image formed on a photoreceptor onto a transfer sheet. One method is to directly transfer a toner image formed on a photoreceptor onto a transfer sheet as shown in FIG. 1, and the other method is to transfer a toner image onto an intermediate transferer once, and then transfer the toner image onto a transfer sheet with the intermediate transferee. Both of these methods can be used in the present invention.

A transfer belt 10 is used in FIG. 1, and a transfer charger and a transfer roller besides the transfer belt can be used. Particularly, contact type transferers such as the transfer belt and transfer roller producing less ozone are preferably used. Known transferers can be used provided they satisfy the conditions of the present invention.

Either a constant voltage method or a constant current method can be used as a method of applying voltage/current in transferring. The constant current method is preferably used because of its capability of maintaining the amount of transfer charge and stability. Particularly, a method of controlling the current to a photoreceptor by reducing a current to a transferer, not to a photoreceptor, out of a current fed from a electrical power supplier (e.g., a high voltage electrical source) feeding a charge to the transferer. Specifically, to determine the current flow in a roller supporting a transfer belt, associated members such as rollers are not directly grounded and a current flow in the associated members is returned to the high voltage electrical source, and a constant current control using a high voltage electrical source having a feedback function such that the difference between the current and the output power of the high voltage electrical source is constant, is preferably used. An embodiment of a circuit capable of performing such control is shown in FIG. 12A.

Figure 12A:
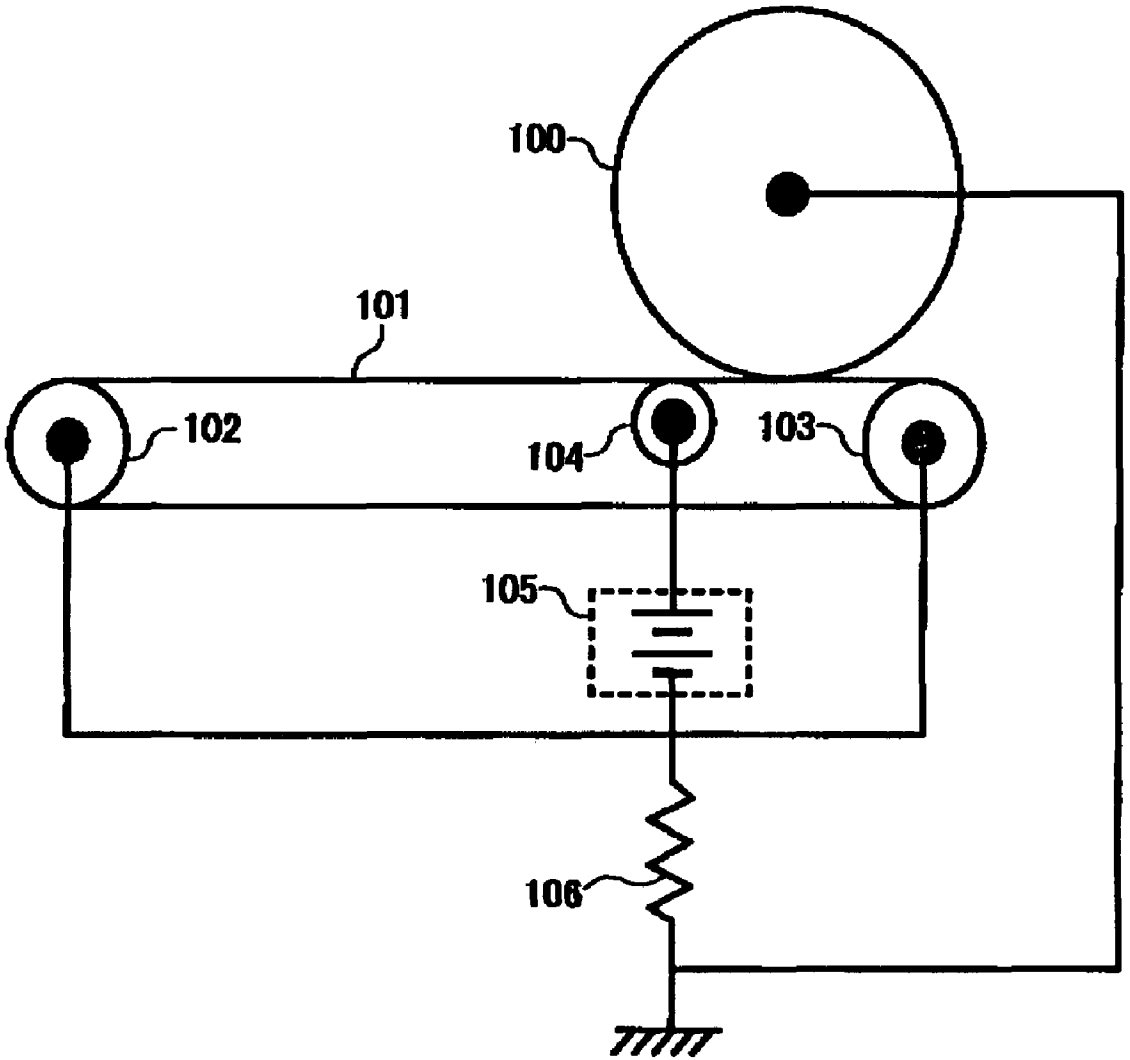
FIGS. 12A and 12B are diagrams showing an embodiment of the transfer circuit capable of controlling a constant current of the present invention.

The transferer shown in FIG. 12A includes a transfer feeding belt 101, a drive roller 102 supporting the transfer feeding belt 101, a driven roller 103, a bias roller 104 contacting a backside of the transfer feeding belt 101 and a cleaner (not shown). The drive roller 102 is connected with a main motor through a gear and the motor rotates the transfer feeding belt 101. The transfer feeding belt 101 contacts and leaves from a photoreceptor drum 100 by a belt contacting and releasing function.

A transfer bias having a reverse polarity to the toner charge polarity is applied to the bias roller 104 from a high voltage electrical source 105 when a transfer sheet is fed to the transferee. A charge having a reverse polarity to the toner charge polarity is applied to the transfer sheet at a nip (a transfer nip) of the transfer feeding belt 101 and photoreceptor drum 100 from the a high voltage electrical source 105 through the bias roller 104 and the transfer feeding belt 101, and a toner image on the photoreceptor drum 100 is transferred onto the transfer sheet.

The transfer feeding belt 101 applied with a transfer bias from the high voltage electrical source 105 through the bias roller 104 electrostatically absorbs a transfer sheet and feeds them, and electrostatically separates the transfer sheet from the photoreceptor 100 after a toner image is transferred onto the transfer sheet. A transfer sheet which is not electrostatically separated from the photoreceptor 100 by the transfer feeding belt 101 is separated therefrom by a separation pick (not shown) and fed by the transfer feeding belt 101.

The transfer feeding belt 101 has a resistance of from $1\times10^{6}$ to $1\times10^{12}$ $\Omega/cm^2$ and can constantly transfer a toner image well regardless of the resistance variation thereof, environmental variation and thickness of the transfer sheet. The bias roller 104 contacts the transfer feeding belt 101 downstream of the rotating direction thereof than the transfer nip, and is rotated by the main motor accompanied with the transfer feeding belt 101.

The feedback electrode in this embodiment is not a metallic plate, but the drive roller 102 and driven roller 103 themselves. The drive roller 102 and driven roller 103 are formed of electroconductive metallic rollers, and can reduce sliding resistance to the transfer feeding belt 101 without limit and reliably serve as the feedback electrode. When the drive roller 102 and driven roller 103 also serve as the feedback electrode, the apparatus can be simplified and the cost can be reduced. The drive roller 102 and driven roller 103 are connected with a lower voltage (ground) terminal of the high voltage electric source 105. The lower voltage terminal of the high voltage electric source 105 is grounded through a current detection resistance 106, and the photoreceptor drum 100 is grounded through the apparatus. The current detection resistance 106 is used as current detection means to detect a transfer current transferring a toner image.

Figure 12B:
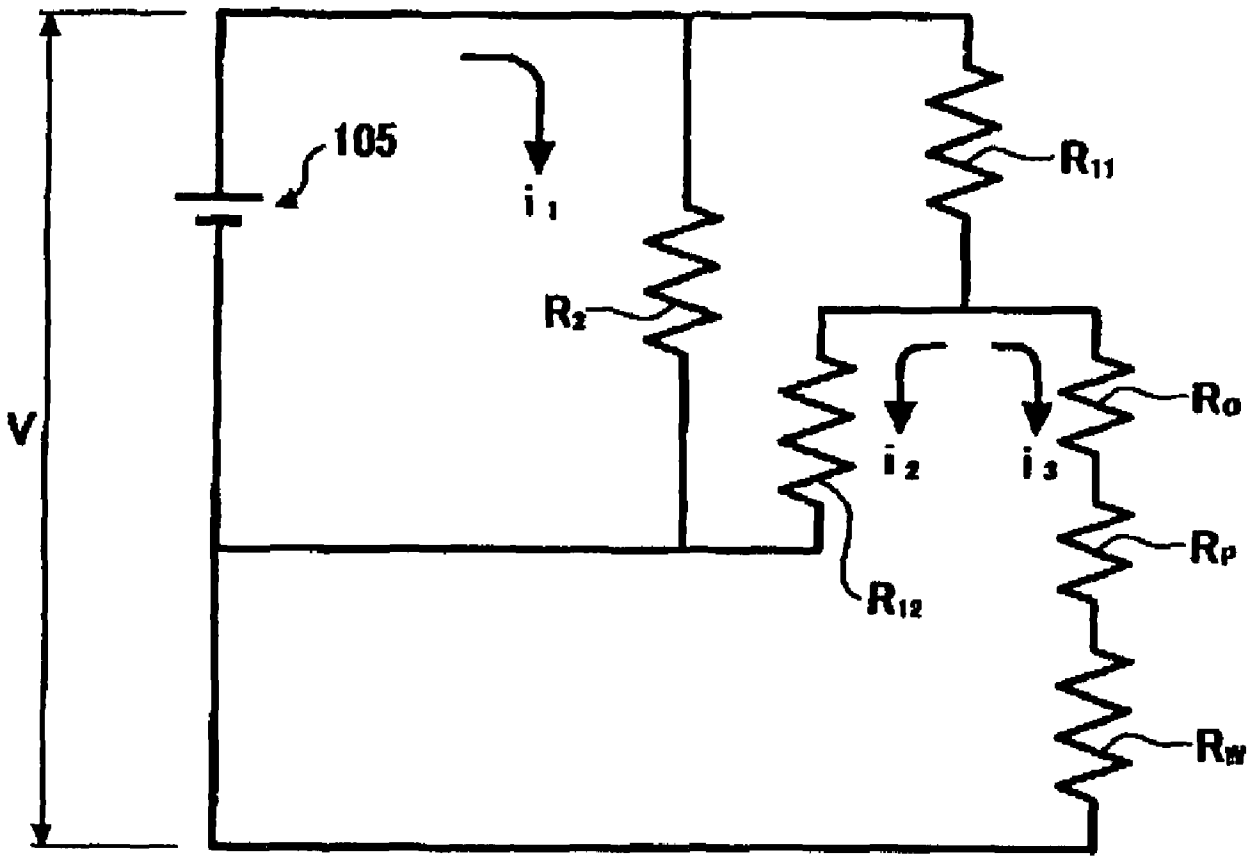

FIG. 12B shows an equivalent circuit of the transferee. In FIG. 12, R11 represents the resistance between the bias roller 104 and the transfer nip in the transfer feeding belt 101; R12 represents the resistance between the transfer nip and the driven roller 103 in the transfer feeding belt 101; R2 represents the resistance between the bias roller 104 and the drive roller 102 in the transfer feeding belt 101; RD represents the resistance of the photoreceptor drum 100; RP represents the resistance of the transfer sheet; and RW represents the resistance of the current detection resistance 106. The resistance R1 between the bias roller 104 and the driven roller 103 in-the transfer feeding belt 101 is R11+R12.

i1 is the current passing the bias roller 104, transfer feeding belt 101 and drive roller 102 from the high voltage electrical source 105; i2 is the current passing the bias roller 104, transfer feeding belt 101 and driven roller 103 from the high voltage electrical source 105; and i3 is the current passing the bias roller 104, transfer feeding belt 101 and photoreceptor drum 100 from the high voltage electrical source 105.

In this embodiment, the high voltage electrical source 105 applies a transfer bias to the bias roller 104 when a transfer sheet fed from a resist roller is transported by the transfer feeding belt 101. The transfer bias current applied from the high voltage electrical source 105 to the bias roller 104 passes the transfer feeding belt 101, transfer sheet and photoreceptor drum 100, and a part of the current passes the transfer feeding belt 101, drive roller 102 and driven roller 103.

The current i3 from the bias roller 104 to the photoreceptor drum 103 through the transfer feeding belt 101 is a transfer current to transfer a toner image and is grounded through the apparatus. The current i3 returns to the high voltage electrical source 105 through the current detection resistance 106. The currents i1 and i2 passing the transfer feeding belt 101, drive roller 102 and driven roller 103 from the bias roller 104 return to the high voltage electrical source 105 without passing the current detection resistance 106. A transfer current passing the current detection resistance 106 is determined from a potential difference between both ends thereof and resistance RW thereof.

In this embodiment, the high voltage electrical source 105 comprises a transfer bias electrical source feeding a transfer bias current to the bias roller 104 and a constant current controller controlling a transfer current to the current detection resistance 106 from the transfer bias electrical source (the difference between the current from the bias roller 104 and the feedback current to the feedback electrodes 102 and 103) such that the transfer current is constant. The constant current controller controls an output current of the transfer bias electrical source with a PWM pulse and controls the transfer bias current so as to be constant by renewing the duty ratio of the PWM pulse (or a gain of the output current of the transfer bias electrical source) with a predetermined frequency according to the voltage of the current detection resistance 106. Therefore, in the transfer nip, a transfer electrical field formed by surface potentials of a toner layer on the photoreceptor drum 100 and the transfer sheet can be constant, and a toner image can be easily transferred regardless of resistance variation of the transfer feeding belt 101, environment variation and thickness of the transfer sheet, resulting in a good copy image.

The constant current controller of the high voltage electrical source 105 controls the output current of the transfer bias electrical source with a PWM pulse and renews the duty ratio of the PWM pulse (or the gain of the output current of the transfer bias electrical source) with a predetermined frequency according to the voltage of the current detection resistance 106. The renewal frequency (cycle) is not greater than 0.5 cycle/mm or not less than 1.5 cycle/mm in spatial frequency, or not greater than 1 dot line written by laser beam which is not less than the lower limit of human sight. Therefore, the occurrence of banding on a copy image due to the renewal frequency of the transfer current can be prevented.

Furthermore, the transfer current i3 is a current practically serving to transfer a toner image, and i2 and i1 are feedback currents not serving to transfer a toner image. In this embodiment, a transfer bias voltage applied to the bias roller 104 from the high voltage electrical source 105 is determined by the resistances R11, RD, RP and RW and transfer current i3 because the transfer current i3 is constantly controlled by the constant current controller of the high voltage electrical source 105. Accordingly, when the R11 is larger than the R2, i1 not serving to transfer a toner image becomes large and the capacity of the transfer bias electrical source has to be large, which is not an effective system. Therefore, in this embodiment, when the distance between the bias roller 104 and driven roller 103 is L1, and the distance between the bias roller 104 and drive roller 102 is L2, it is designed so that L1 is shorter than L2 such that R1 is smaller than R2. Therefore, the capacity of the transfer bias electrical source can be small.

The transfer current is a current based on the charge required to peel off a toner electrostatically adhered onto a photoreceptor and transfer the toner onto a receiver such as a transfer sheet and an intermediate transferee. To avoid a defective transfer such as residual toner after transfer, the transfer current should be large. However, when negative and positive development is used, a charge having the reverse polarity to that of a photoreceptor is applied thereto and the photoreceptor electrostatically fatigues significantly. Therefore, conventional electrophotographic photoreceptors electrostatically fatigue quickly due to the application of a reverse charge, and it is difficult to increase the transfer current. The present inventors discovered that a photoreceptor using a titanylphthalocyanine crystal having a specific form solves the problem.

The larger the transfer current, it is advantageous to apply a charge larger than the electrostatic adherence between a photoreceptor and a toner. However, when the transfer current exceeds a threshold, an electrical discharge phenomenon between the transfer sheet and the photoreceptor occurs, resulting in scattering of a toner image which has been finely developed. Therefore, the threshold is within a range where the electrical discharge phenomenon does not occur. The threshold depends on the gap (distance) between the transfer sheet and photoreceptor, and on the materials thereof. However, a transfer current of about 200 μA or less can avoid the electrical discharge phenomenon. Therefore, the upper limit of the transfer current is about 200 μA.

Suitable light sources for use in a discharging lamp 2 include general light-emitting materials such as fluorescent lamps, tungsten lamps, halogen lamps, mercury lamps, sodium lamps, LEDs, LDs, light sources using electroluminescence (EL), etc. In addition, in order to obtain light having a desired wave length range, filters such as sharp-cut filters, band pass filters, near-infrared cutting filters, dichroic filters, interference filters, color temperature converting filters, etc. can be used.

The above-mentioned light sources can be used for not only the process illustrated in FIG. 1, but also other processes such as a transfer process, a discharging process, a cleaning process, a pre-exposure process including light irradiation to the photoreceptor.

In the above-mentioned charging method, when the AC voltage is overlapped or the residual potential of a photoreceptor is small, this discharge lamp can be omitted. In addition, instead of an optical discharger, an electrostatic discharger such as grounded discharging brushes to which a reverse bias is applied can be used.

When a toner image formed on the photoreceptor 1 by a developing unit 6 is transferred onto a transfer sheet 7, the entire toner image is not transferred thereto, and residual toner remains on the surface of the photoreceptor 1. The residual toner is removed from the photoreceptor 1 by the fur brush 14 and the cleaning blade 15. The residual toner remaining on the photoreceptor 1 can be removed only by a cleaning brush. Suitable cleaning brushes include known cleaning brushes such as fur brushes and mag-fur brushes.

Figure 3:
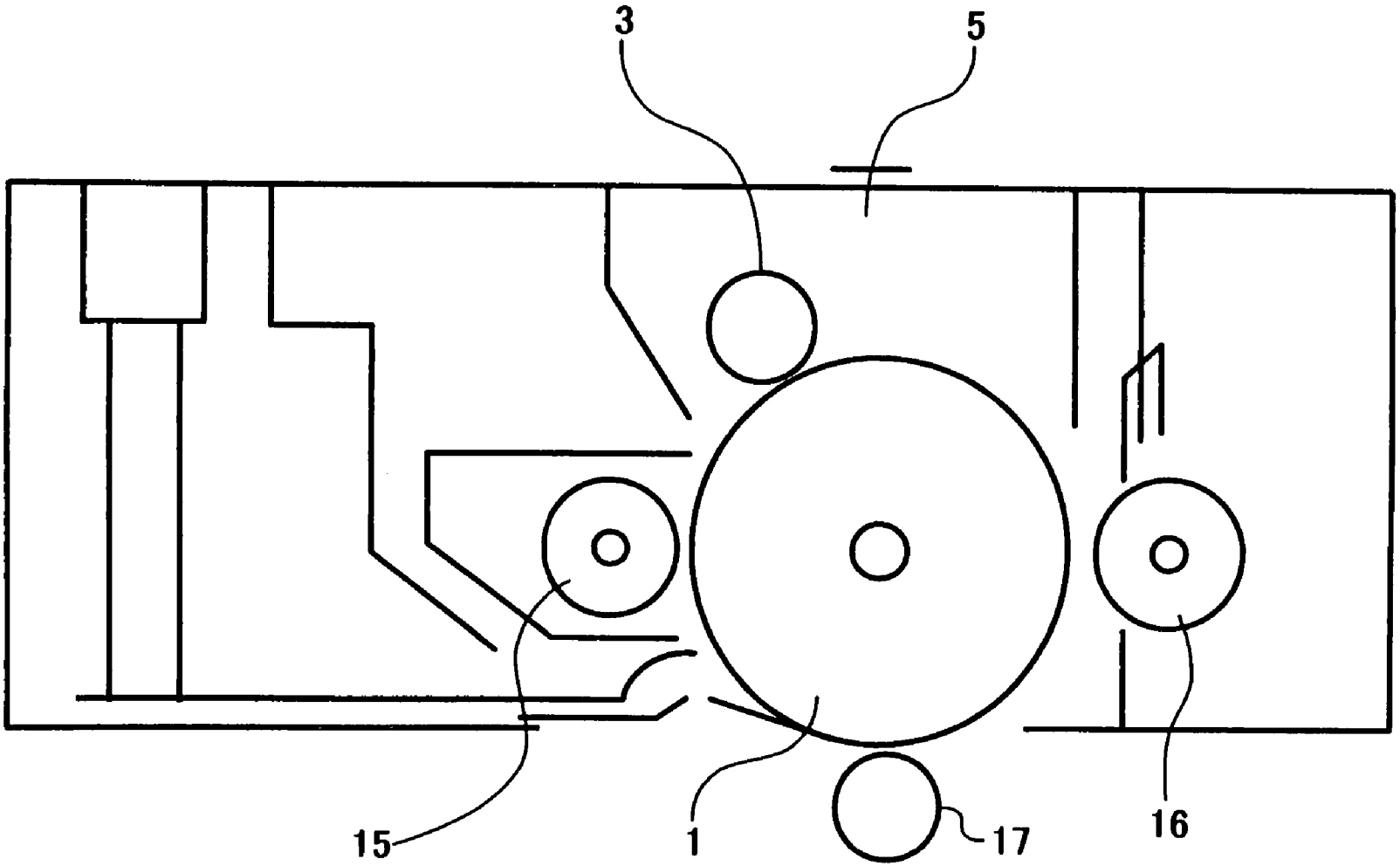
FIG. 3 is a schematic view for explaining the process cartridge for an electrophotographic image forming apparatus of the present invention.

The above-mentioned image forming units may be fixedly set in a copier, a facsimile or a printer. However, the image forming units may be set therein as a process cartridge. A process cartridge means an image forming unit (or device)

including at least a photoreceptor, and one of a charger, an imagewise light irradiator, an image developer, an image transferer, a cleaner and a discharger. Various process cartridges can be used in the present invention. FIG. 3 illustrates an embodiment of the process cartridge. A photoreceptor 1 is formed of a photosensitive layer located overlying an electroconductive substrate, which includes at least a charge generation layer and a charge transport layer, wherein the charge generation layer includes titanylphthalocyanine crystals having a CuKα 1.542 Å X-ray diffraction spectrum including plural diffraction peaks, wherein a maximum diffraction peak is observed at a Bragg (2θ) angle of 27.2°; main peaks are observed at 9.4°, 9.6° and 24.0°; and a minimum diffraction peak is observed at 7.3°; and no diffraction peak is observed at an angle greater than 7.3° and less than 9.4°, wherein said angles may vary by ±0.2° and the minimum interval where no peak is observed between required peaks at 7.3 and 9.4 is 2.0 degrees absolute or more. When the process cartridge is used in an electrophotographic image forming apparatus, a transferer therein applies a current of not less than 65 μA to the photoreceptor.

The transfer current can be defined as a current flow to a photoreceptor from a charger. When a toner image is directly transferred onto a transfer material such as a paper, the transfer current can be defined as a current flow to a photoreceptor when the transfer material has the same width as the transfer member. When an intermediate transferer is used, the transfer current can be defined as a current flow to a photoreceptor from the intermediate transferee. Several methods of measuring the transfer current are available, and two of them will be explained.

One method is to directly measure the current flow in a photoreceptor by measuring the current flow from the photoreceptor to a ground. However, when measured, the current from a charger, etc. is included when an electrophotographic image forming apparatus operates and the transfer current has to be measured when only a transfer member operates.

The other method is to indirectly measure the transfer current. The transfer current to a photoreceptor is indirectly determined from the difference between the current used for a transferer from a high voltage electrical source and the current flow to transferers such as a drive roller for a transfer belt besides the photoreceptor. In this method, the high voltage electrical source has a feedback function, the rollers are not grounded and return a current to the high voltage electrical source to detect the difference between the output current and the returned current.

Figure 4:
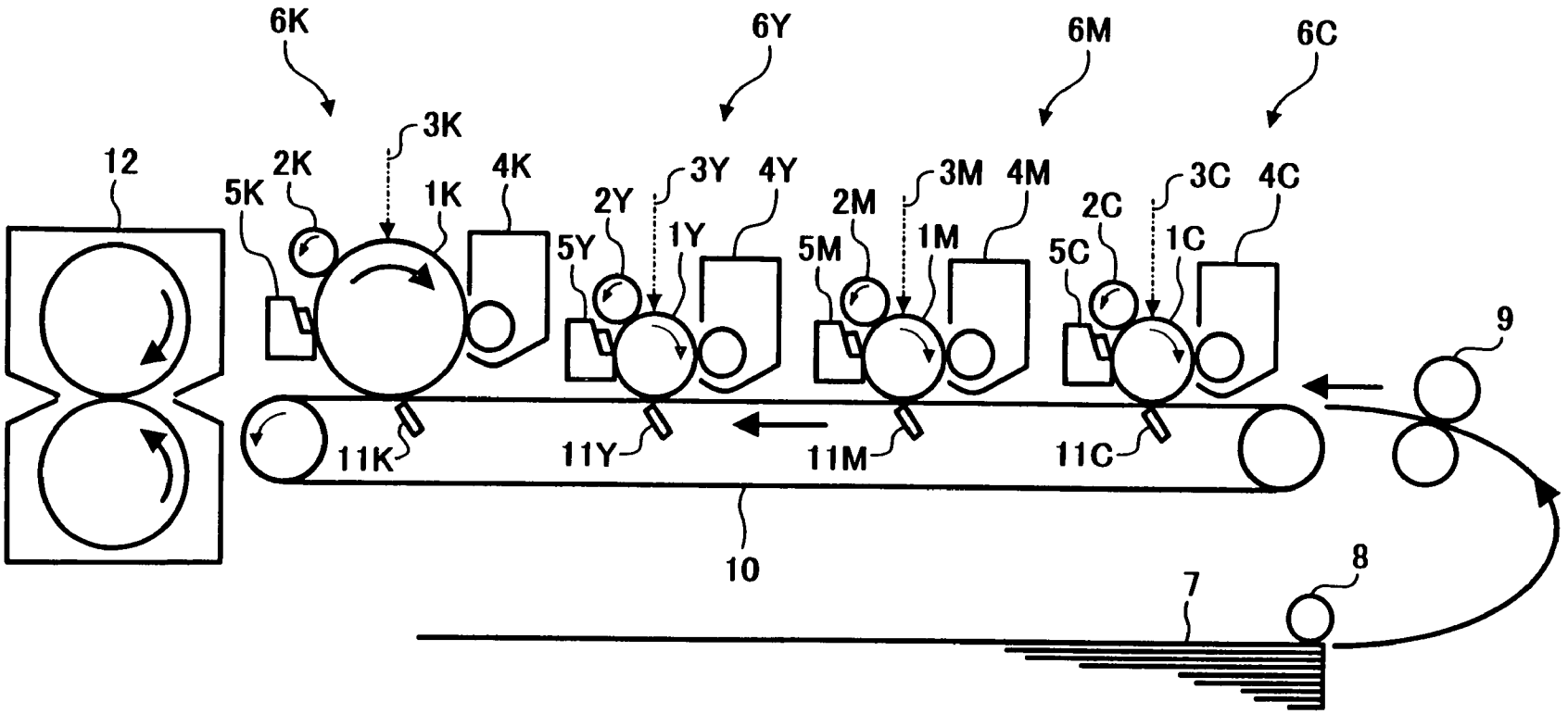
FIG. 4 is a schematic view for explaining the tandem-type full color electrophotographic image forming apparatus of the present invention.

FIG. 4 is a schematic view illustrating an embodiment of the tandem-type full-color image forming apparatus of the present invention, and the following modified embodiment is included in the present invention.

In FIG. 4, numerals 1C, 1M, 1Y and 1K represent drum-shaped photoreceptors, and are formed of a photosensitive layer located overlying an electroconductive substrate, which includes at least a charge generation layer and a charge transport layer, wherein the charge generation layer includes titanylphthalocyanine crystals having a CuKα 1.542 Å X-ray diffraction spectrum including plural diffraction peaks, wherein a maximum diffraction peak is observed at a Bragg (2θ) angle of 27.2°; main peaks are observed at 9.4°, 9.6° and 24.0°; and a minimum diffraction peak is observed at 7.3°; and no diffraction peak is observed at an angle greater than 7.3° and less than 9.4°, wherein said angles may vary by ±0.2° and the minimum interval where no peak is observed between required peaks at 7.3 and 9.4 is 2.0 degrees absolute or more. The photoreceptors 1C, 1M, 1Y and 1K rotate in the direction indicated by the arrows, and around them, chargers 2C, 2M, 2Y and 2K; image developers 4C, 4M, 4Y and 4k; and cleaners 5C, 5M, 5Y and 5K are arranged in a rotation order thereof. The chargers 2C, 2M, 2Y and 2K uniformly charge surfaces of the photoreceptors. Laser beams 3C, 3M, 3Y and 3K from irradiators (not shown) irradiate the surfaces of the photoreceptors between the chargers 2C, 2M, 2Y and 2K and image developers 4C, 4M, 4Y and 4k to form electrostatic latent images on the surfaces of the photoreceptors 1C, 1M, 1Y and 1K. Four image forming units 6C, 6M, 6Y and 6K including the photoreceptors 1C, 1M, 1Y and 1K are arranged along a transfer feeding belt 10 feeding a transfer material. The transfer feeding belt 10 contacts the photoreceptors 1C, 1M, 1Y and 1K between the image developers 4C, 4M, 4Y and 4k and cleaners 5C 5M, 5Y and 5K of the image forming units 6C, 6M, 6Y and 6K. Transfer brushes 11C, 11M, 11Y and 11K are arranged on the backside of the transfer feeding belt 10, which is the opposite side in relation to the photoreceptors, to apply a transfer bias to the transfer feeding belt 10. The image forming units 6C, 6M, 6Y and 6K just handle different color toners respectively, and have the same structures.

Figure 7:
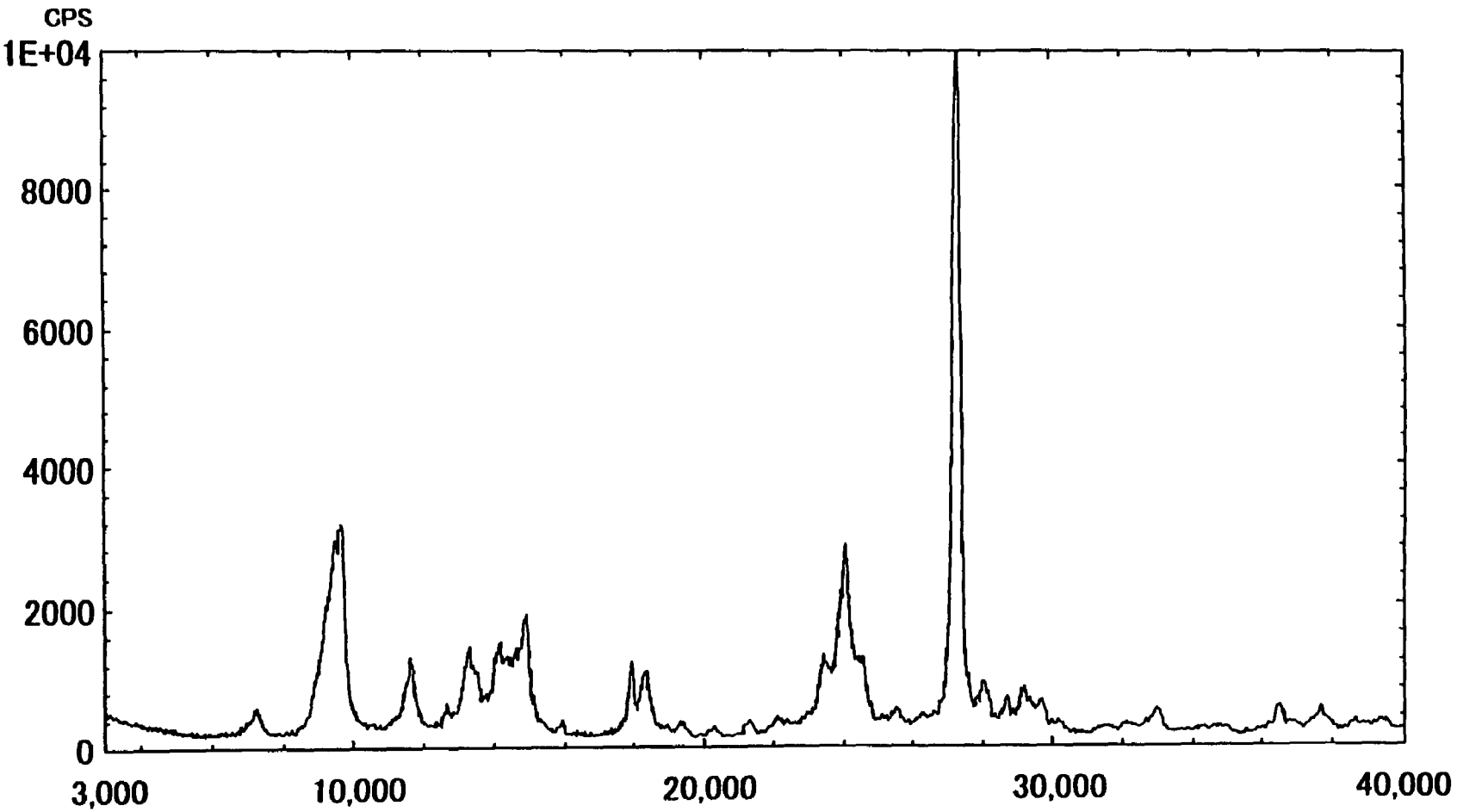
FIG. 7 is a diagram showing an X-ray spectrum of the titanylphthalocyanine crystal prepared in Synthesis Example 1.

In the full-color electrophotographic apparatus in FIG. 4, images are formed as follows. First, in the image forming units 6C, 6M, 6Y and 6K, the photoreceptors 1C, 1M, 1Y and 1K are charged by the chargers 2C, 2M, 2Y and 2K rotating in the same direction as the photoreceptors. Next, the laser beams 3C, 3M, 3Y and 3K from irradiators (not shown) irradiate the surfaces of the photoreceptors to form electrostatic latent images having different colors respectively thereon. Then, the image developers 4C, 4M, 4Y and 4K develop the electrostatic latent images to form toner images. The image developers 4C, 4M, 4Y and 4K develop the electrostatic latent images with toners having a cyan color C, a magenta color M, a yellow color Y and a black color K respectively. The color toner images respectively formed on the photoreceptors 1C, 1M, 1Y and 1K are overlaid on a transfer sheet 7. The transfer sheet 7 is fed by a paper feeding roller 8 from a tray and stopped once by a pair of resist rollers 9, and fed onto the transfer feeding belt 10 in timing with formation of the toner images on the photoreceptors. The transfer sheet 7 borne by the transfer feeding belt 10 is transferred to the contact (transfer) position of each photoreceptor 1C, 1M, 1Y and 1K, where each color toner image is transferred onto the transfer sheet 7. The toner images on the photoreceptors are transferred to the transfer sheet 7 by an electric field formed with a potential difference between the transfer bias applied by the transfer brushes 11C, 11M, 11Y and 11K and the photoreceptors 1C, 1M, 1Y and 1K. The transfer sheet 7 having passed the four transfer positions and bearing the four color toner images overlaid thereon is fed to a fixer 12 fixing the toner images on the transfer sheet. The transfer sheet 7 on which the toner images are fixed is fed onto a sheet receiver (not shown). Residual toner remaining on the photoreceptors 1C, 1M, 1Y and 1K, which were not transferred on the transfer sheet at the transfer position are collected by the cleaners 5C 5M, 5Y and 5K. In an embodiment in FIG. 7, the image forming units are aligned in the order of C, M, Y and K from the upstream to the downstream of the feeding direction of the transfer sheet. However, the order is not limited thereto and the color orders are optional. When only a black image is produced, the image forming units 6C, 6M and 6Y except for 6K can be stopped in the apparatus of the present invention. In FIG. 7, the charger contacts the photoreceptor;

however, a gap therebetween of from 10 to 200 μm can decrease the amount of abrasion thereof and toner filming over the charger.

The above-mentioned image forming units may be fixedly set in a copier, a facsimile or a printer. However, the image forming units may be set therein as a process cartridge. A process cartridge means an image forming unit (or device) including at least a photoreceptor, and one of a charger, an imagewise light irradiator, an image developer, an image transferer, a cleaner and a discharger.

Hereinafter, the electrophotographic photoreceptor for use in the present invention will be explained in detail. The electrophotographic photoreceptor of the present invention is an electrophotographic photoreceptor formed of a photosensitive layer located overlying an electroconductive substrate, which includes at least a charge generation layer and a charge transport layer, wherein the charge generation layer includes titanylphthalocyanine crystals having a CuKα 1.542 Å X-ray diffraction spectrum including plural diffraction peaks, wherein a maximum diffraction peak is observed at a Bragg (2θ) angle of 27.2°; main peaks are observed at 9.4°, 9.6° and 24.0°; and a minimum diffraction peak is observed at 7.3°; and no diffraction peak is observed at an angle greater than 7.3° halogenation. When titanylphthalocyanine crystals include halogenated titanylphthalocyanine crystals as an impurity, a photoreceptor using these titanylphthalocyanine crystals exhibits deterioration in its photosensitivity and chargeability in many cases. Also in the present invention, the titanylphthalocyanine crystals free from halogenation disclosed in Japanese Laid-Open Patent Publication No. 2001-19871 are preferably used.

Now, a method of synthesizing titanylphthalocyanine crystals having a specific crystal form for use in the present invention will be explained.

First, a method of synthesizing crude titanylphthalocyanine crystals will be explained.

Methods of synthesizing phthalocyanines have been known for a long time, and are disclosed in "Phthalocyanine Compounds" published in 1963 and "The Phthalocyanines" published in 1983, which are written by Moser and other authors, and in Japanese Laid-Open Patent Publication No. 6-293769.

For example, a first method is to heat a mixture of phthalic anhydrides, metals or halogenated metals and urea in the presence or absence of a solvent having a high boiling point. In this method, catalysts such as ammonium molybdate are optionally used together. A second method is to heat phthalonitriles and halogenated metals in the presence or absence of a solvent having a high boiling point. This method is used to produce phthalocyanines which cannot be produced by the first method, such as aluminium phthalocyanine, indium phthalocyanine, oxovanadium phthalocyanine, oxotitanium phthalocyanine and zirconium phthalocyanine. A third method is to react phthalic anhydrides or phthalonitrile with ammonia first to prepare an intermediate such as 1,3-diiminoisoindoline and to react the intermediate with halogenated metals in a solvent having a high boiling point. A fourth method is to react phthalonitrile with metalalkoxide in the presence of urea, etc. Particularly, the fourth method is significantly an effective method to synthesize a material for electrophotography because chlorination (halogenation) of a benzene ring does not occur.

Next, a method of synthesizing an amorphous titanylphthalocyanine (low crystallinity titanylphthalocyanine) will be explained. This is a method of dissolving phthalocyanine in sulfuric acid, diluting the mixture with water and re-precipitating. An acid paste method or an acid slurry method can be used.

A specific method is to dissolve the above-mentioned synthesized crude titanylphthalocyanine crystals in an amount of concentrated sulfuric acid which is 10 to 50 times as much as the amount of crude titanylphthalocyanine crystals, optionally remove insolubles with a filter, etc. and slowly put the mixture into an amount of sufficiently cooled or iced water which is 10 to 50 times as much as the amount of concentrated sulfuric acid to re-precipitate the titanylphthalocyanine. After the precipitated titanylphthalocyanine is filtered, the titanylphthalocyanine is washed with ion exchange water and filtered. This operation is sufficiently repeated until the filtrate becomes neutral. Finally, after the titanylphthalocyanine is washed with clear ion exchange water, it is filtered to prepare a water paste having a solid concentration of from 5 to 15 by weight. Thus, the amorphous titanylphthalocyanine (low crystallinity titanylphthalocyanine) for use in the present invention is prepared. The amorphous titanylphthalocyanine (low crystallinity titanylphthalocyanine) preferably has at least a maximum diffraction peak at a Bragg (2θ) of from 7.0 to 7.5±0.2° when irradiated with a specific X-ray of CuKα having a wavelength of 1.542 Å. Particularly, the half width of the diffraction peak is preferably not less than 1°. Furthermore, the amorphous titanylphthalocyanine (low crystallinity titanylphthalocyanine) preferably has an average primary particle size of not greater than 0.1 μm.

Next, the crystal conversion method will be explained.

Crystal conversion is a process of converting the above-mentioned amorphous titanylphthalocyanine (low crystallinity titanylphthalocyanine) to a crystal form having at least a maximum diffraction peak at a Bragg (2θ) angle of 27.2±0.2° of when irradiated with a specific X-ray of CuKα having a wavelength of 1.542 Å, main peaks at 9.4°, 9.6° and 24.0°, a minimum dif fraction peak at 7.3°, not having peaks at from 7.4° to 9.4°, and further not having a peak at 26.3°.

A specific method of obtaining such titanylphthalocyanine crystals is to mix and stir the amorphous titanylphthalocyanine (low crystallinity titanylphthalocyanine) with an organic solvent in the presence of water without drying the amorphous titanylphthalocyanine (low crystallinity titanylphthalocyanine).

Any organic solvent for use in this method can be used if only a desired crystal form can be obtained. In particular, a solvent selected from the group consisting of tetrahydrofuran, toluene, dichloromethane, carbon bisulfide, o-dichlorobenzene and 1,1,2-trichloroethane is preferably used. These solvents are preferably used alone, but can also be used in combination or with other solvents.

This crystal conversion method is disclosed in Japanese Laid-Open Patent Publication No. 2001-19871. The smaller the particle size of the titanylphthalocyanine crystal, the better the titanylphthalocyanine crystal performs its function.

The present inventors observed in the crystal conversion process that the amorphous titanylphthalocyanine (low crystallinity titanylphthalocyanine) has a primary particle diameter of not greater than 0.1 μm (almost all the particles have a diameter of from about 0.01 to 0.05 μm), and that the crystal grows during the crystal conversion process. Usually, in such a crystal conversion, a sufficient time is spent for the crystal conversion such that the materials do not remain and filtered titanylphthalocyanine crystals having a desired crystal form are obtained after sufficient crystal conversion.

Therefore, the crystals after the crystal conversion have large primary particles (about 0.3 to 0.5 μm in diameter) although a material having sufficiently small primary particles is used.

When the thus prepared titanylphthalocyanine crystal is dispersed, strong shear is applied to make the particle size small (not greater than about 0.2 μm in diameter). Furthermore, sufficient energy is optionally applied to pulverize the primary particles. Consequently, some of the particles have an undesired crystal form as mentioned above.

On the other hand, in the present invention, titanylphthalocyanine crystals having a primary particle size as small as possible are obtained before the crystals have a chance to grow significantly (before the crystal grows to have a diameter greater than 0.2 μm). The particle size after the crystal conversion process becomes large in proportion to the duration of the crystal conversion process. Therefore, it is essential to increase the crystal conversion efficiency and complete the conversion in a short time. A few important points will be explained.

One point is to select a suitable crystal conversion solvent to increase the crystal conversion efficiency. Another point is to strongly stir the solvent and the titanylphthalocyanine water paste to complete the crystal conversion in a short time. Specifically, the solvent and titanylphthalocyanine water paste are strongly stirred by a propeller or a homomixer to complete the crystal conversion in a short time. These methods can be used to prepare titanylphthalocyanine crystals after the crystals are sufficiently converted without any more crystal growth and formation of residual material.

In addition, it is an effective method to immediately stop the reaction after a predetermined amount of reaction (crystal conversion) is completed because the crystal particle size grows in proportion to the duration of the crystal conversion process. Specific examples of the method include immediately adding a large amount of a solvent to stop the crystal conversion after sufficient crystal conversion occurs. Specific examples of this solvent include alcohol and ester solvents. An amount of solvent which is 10 times the amount of the crystal conversion solvent can stop the crystal conversion.

The smaller the primary particle size, the better the performance of the photoreceptor. However, when the primary particle size is too small, an adverse effect in regard to filtering the pigment and the dispersion stability of the dispersion liquid occasionally occurs. When the primary particle size is too small, it takes quite a long time to filter the particles. In addition, the surface area of the pigment particle becomes large in a dispersion liquid when the primary particle size is too small and the possibility of re-aggregation of the particles increases. Therefore, the pigment preferably has a particle size of from about 0.05 to 0.2 μm.

When the titanylphthalocyanine crystal is dispersed by strong shear, it should have a particle size of less than 0.3, preferably not greater than 0.25, and more preferably not greater than 0.2 μm. Furthermore, the titanylphthalocyanine crystal is optionally dispersed with high energy levels to pulverize the primary particles. Consequently, some of the particles tend to change to an undesired crystal form.

The particle size is the volume-average particle diameter, and is determined by an ultra centrifugal automatic particle diameter distribution measuring apparatus, CAPA-700 from Horiba, Ltd. The volume-average particle diameter is determined as a particle diameter equivalent to 50% (Median) of the cumulative distribution. However, because the measuring apparatus occasionally cannot detect a small amount of coarse particles, it is essential to directly observe the titanylphthalocyanine crystal powder or dispersion liquid by an electron microscope to determine the size.

When measuring the average particle size, if extremely large particles are present in an amount of several percent or more, the particles can be detected. However, when the amount of extremely large particles is about 1% or less, the particles occasionally cannot be detected. Consequently, coarse particles cannot be detected in the method of measuring the average particle size.

Figure 14:
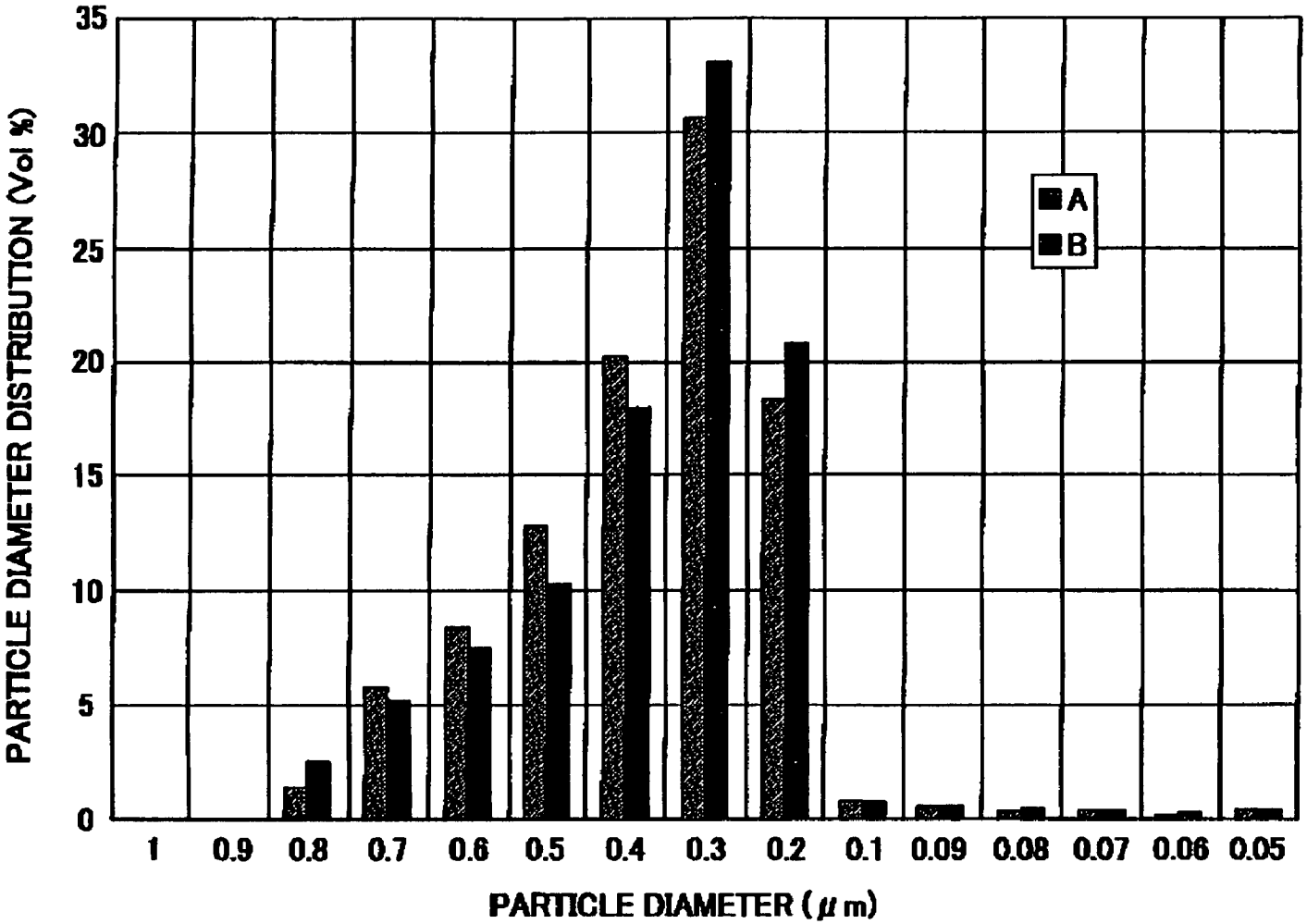
FIG. 14 is a diagram showing average particle diameters and particle diameter distributions of a dispersion liquid dispersed for a long time and a dispersion liquid dispersed for a short time.

The average particle diameters and particle diameter distributions of two dispersion liquids were measured by an ultra centrifugal automatic particle diameter distribution measuring apparatus, CAPA-700 from Horiba, Ltd. One dispersion liquid was dispersed for a longer time than the other dispersion liquid, under the same dispersing conditions. The results are shown in FIG. 14. In FIG. 14, B is the dispersion liquid dispersed for a longer time than dispersion liquid A. The particle diameter distributions thereof showed little difference. The average particle diameter of dispersion liquid A is 0.29 μm and that of dispersion liquid B is 0.28 μm. In view of the magnitude of the error of measurement, there is no difference between dispersion liquids A and B.

Therefore, if one only regulates the known average particle diameter (size), one cannot detect a small amount of residual coarse particles and therefore cannot meet the requirements of the recent high-resolution negative and positive development processes. The small amount of residual coarse particles can be identified only by observing a coating liquid with a microscope.

To solve this problem, obtaining titanylphthalocyanine crystals having a primary particle size as small as possible is effective. For this purpose, selecting a suitable crystal conversion solvent as mentioned above to enhance the crystal conversion efficiency and strongly stirring the solvent and titanylphthalocyanine water paste as prepared as above such that they sufficiently contact to each other to complete the crystal conversion in a short time is an effective method. Specifically, stirring methods using strong stirrers such as propeller stirrers and homogenizers (homomixers) are used to perform the crystal conversion in a short time. These methods can obtain titanylphthalocyanine crystals sufficiently converted without crystal growth and remaining materials.

In addition, as mentioned above, because the crystal particle size grows in proportion to the crystal conversion time, when a predetermined reaction (crystal conversion) is completed, it is an effective method to stop the reaction immediately. For example, after the crystal conversion is performed, a large amount of a solvent preventing crystal conversion is immediately included in the mixture. Suitable solvents preventing a crystal conversion include alcohol solvents, ester solvents, etc. These solvents, present in an amount which is approximately ten times as much as the amount of crystal conversion solvent, can stop the crystal conversion.

Such crystal conversion methods can produce titanylphthalocyanine crystals having a primary particle diameter of less than 0.3, preferably not greater than 0.25 and more preferably not greater than 0.2 μm. In addition to the technologies disclosed in Japanese Laid-Open patent Publication No. 2001-19871, such crystal conversion methods are optionally used together to increase the effect of the present invention.

Next, the converted titanylphthalocyanine crystals are immediately filtered and separated from the crystal conversion solvent. A filter having a proper size is used for the filtration. Filtration under reduced pressure is most preferable.

Then, the separated titanylphthalocyanine crystals are optionally heated and dried. A known type of drier can be used for heating and drying the crystal. However, a fan drier is preferably used when heating and drying the crystal are performed in the atmosphere. Furthermore, in order to increase the drying speed and provide the effect of the present invention, drying under reduced pressure is quite an effective method.

Particularly, drying under reduced pressure is an effective method for a material which is dissolved by a high temperature or a material the crystal form of which changes. In particular, drying in a vacuum which is higher than 10 mmHg is effective.

The thus prepared titanylphthalocyanine crystals having a specific crystal form are effectively used as a charge controlling agent for an electrophotographic photoreceptor. However, as mentioned above, the crystal form is unstable and has the drawback of easily transforming. However, in the present invention, the primary particles, which are as small as possible, can provide a dispersion liquid comprising the particles having a small average particle diameter and can make the crystal form quite stable.

The dispersion liquid is prepared by typical methods using a ball mill, an attritor, a sand mill, a bead mill, an ultrasonic device, etc., in which the titanylphthalocyanine crystals are optionally dispersed with a binder resin in a proper solvent. The binder resin maybe selected for the electrostatic properties of the resultant photoreceptor, and the solvent may be selected for wettability to the pigment and the dispersability thereof.

It is known that titanylphthalocyanine crystals having at least a maximum diffraction peak at a Bragg (2θ) angle of 27.2±0.2°, when irradiated with a specific X-ray of CuKα having a wavelength of 1.542 Å, are easily transformed to another crystal form by a stress such as heat energy and mechanical shear. The titanylphthalocyanine crystals for use in the present invention are the same, as well. Namely, a dispersion method has to be designed to prepare a dispersion liquid comprising fine particles, but the stability of the crystal form and atomization tend to have a tradeoff relationship. The dispersing conditions are optimized to balance the crystal form stability and atomization. However, the preparation conditions are quite limited and easier methods are required. The following method is effective to solve this problem.

Namely, after a dispersion liquid comprising particles which are as small as possible before the crystal conversion occurs is prepared, the dispersion liquid is filtered. This method can remove a small amount of residual coarse particles which cannot be visually observed (or cannot be detected by a particle diameter measurement) and is quite an effective method to narrow the particle diameter distribution. Specifically, the dispersion liquid is filtered with a filter having an effective pore size of not greater than 3 μm. The method can be used to prepare a dispersion liquid comprising only titanylphthalocyanine crystals having a particle diameter less than 0.3, preferably not greater than 0.25, and more preferably not greater than 0.2 μm.

Hereinafter, the electrophotographic photoreceptor for use in the present invention will be explained, referring to the drawings.

Figure 5:
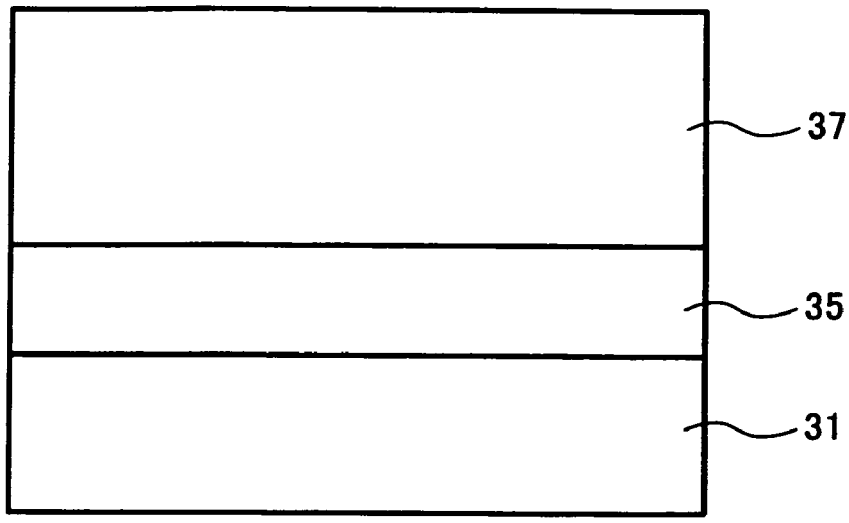
FIG. 5 is a schematic view. illustrating a layer structure of the electrophotographic photoreceptor for use in the present invention.

FIG. 5 is a schematic view illustrating a cross section of an embodiment of the photosensitive layer of the electrophotographic photoreceptor for use in the present invention, in which a charge generation layer (hereinafter referred to as a CGL) 35 including a charge generation material (hereinafter referred to as a CGM) as a main component and a charge transport layer (hereinafter referred to as a CTL) 37 including a charge transport material (hereinafter referred to as a CTM) as a main component are formed on an electroconductive substrate 31.

Figure 6:
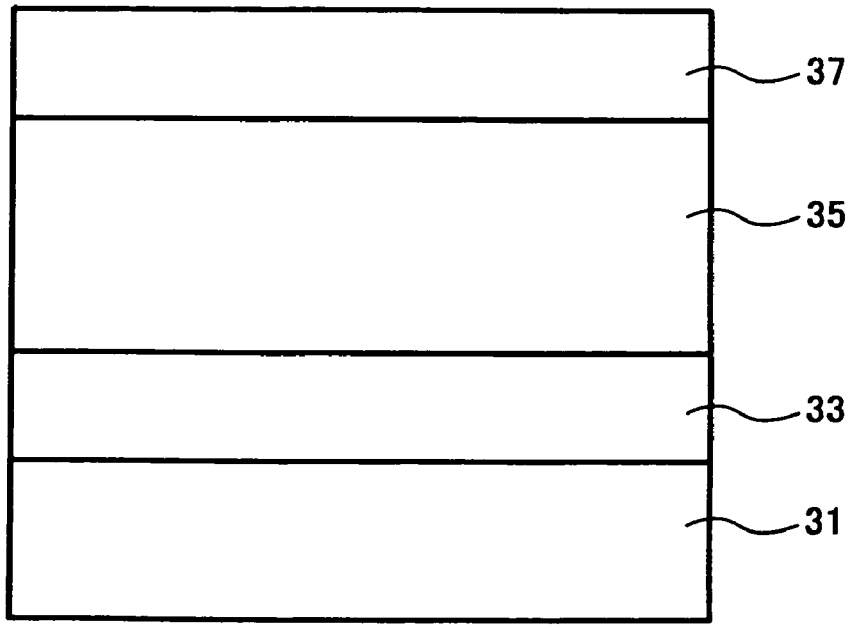
FIG. 6 is a schematic view illustrating another layer structure of the electrophotographic photoreceptor for use in the present invention.

FIG. 6 is a schematic view illustrating a cross section of another embodiment of the photosensitive layer of the electrophotographic photoreceptor for use in the present invention, in which an intermediate layer 33, a CGL 35 including a CGM as a main component and a CTL 37 including a CTM as a main component are formed on an electroconductive substrate 31.

Suitable materials for the electroconductive substrate 31 include materials having a volume resistance not greater than $10^{10}$ Ω·cm. Specific examples of such materials include plastic cylinders, plastic films or paper sheets whose surface is deposited or sputtered with a metal such as aluminum, nickel, chromium, nichrome, copper, gold, silver, platinum and the like, or a metal oxide such as tin oxides, indium oxides and the like. In addition, a plate of a metal such as aluminum, aluminum alloys, nickel and stainless steel and a metal cylinder, which is prepared by forming a tube of a metal such as the metals mentioned above, by a method such as impact ironing or direct ironing, and then treating the surface of the tube by cutting, super finishing, polishing and the like treatments, can also be used as the substrate. Furthermore, endless belts of a metal such as nickel and stainless steel, which are disclosed in Japanese Laid-Open Patent Publication No. 52-36016, can also be used as the substrate 31.

Among these materials, a cylindrical substrate formed of aluminium which is easily coated by an anodic oxide coating method can most preferably be used. The aluminium includes either of pure aluminium or aluminium base alloys. Specifically, aluminium or aluminium base alloys in the thousands, three thousands and six thousands of JIS are most suitable. The anodic oxide coating method is a method of coating various metals and alloyed metals in an electrolyte. A film called alumite formed by the anodic oxide coating method coating the aluminium or aluminium base alloys in an electrolyte is most suitable for the photoreceptor of the present invention. Particularly, when the photoreceptor is used for reverse development (negative and positive development), the photoreceptor has good capability of preventing point defects such as black spots and background fouling.

The anodic oxide coating is performed in an acidic solution using chromic acid, sulfuric acid, oxalic acid, phosphoric acid, boric acid, sulfamic acid, etc. Among these acids, a sulfuric acid solution is most preferably used. For example, the anodic oxide coating is usually performed in conditions of a sulfuric acid concentration of from 10 to 20%; a liquid temperature of from 5 to 25° C.; a current density of from 1 to 4 A/dm$^2$; a bath voltage of from 5 to 40 V; and a coating time of 5 to 60 min. However, the conditions are not limited thereto. Because the thus prepared anodic oxide coated film is porous and highly insulative, the film has a quite an unstable surface. Therefore, as time passes, the properties of the anodic oxide coated film easily change. In order to avoid this, it is preferable that the anodic oxide coated film is further sealed. The sealing methods include dipping the anodic oxide coated film in an aqueous solution including nickel fluoride or nickel acetate, or a boiling water and steam sealing method. Among these methods, the method of dipping the anodic oxide coated film in an aqueous solution including nickel acetate is most preferably used. Following sealing, the anodic oxide coated film is washed to mainly remove unnecessary materials such as metallic salts adhering to the film by the sealing. The excessive materials remaining on a surface of the substrate (the anodic oxide coated film) not only have a bad influence upon quality of a coated film formed thereon but also cause background fouling because low resistance materials typically remain. One washing with purified water may be sufficient, but usually the anodic oxide coated film is washed several times. The final cleaning liquid is preferably as clean as possible (deionized water). In addition, one of the washing times is preferably a physical abrasion washing with a contact member. The thus prepared anodic oxide coated film preferably has a thickness of from about 5 to 15 μm. When the thickness is less than 5 μm, the anodic oxide coated film does not have a sufficient barrier effect. When greater than 15 μm, the time constant as an electrode is so large that the resultant photoreceptor occasionally has a residual potential or a deteriorated response.

Besides, substrates on which a coating liquid including a binder resin and an electroconductive powder is coated can also be used as the substrate 41. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photocrosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

Furthermore, substrates in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate 31.

Next, the photosensitive layer for use in the present invention will be explained. As mentioned above, a multilayer type photosensitive layer formed of a CGL 35 and a CTL 37 is preferably used because of its good sensitivity and durability.

The CGL 35 is a layer including a titanylphthalocyanine crystal as a CGM, which has at least a maximum diffraction peak at a Bragg (2θ) angle of 27.2±0.2° when irradiated with a specific X-ray of CuKα having a wavelength of 1.542 Å. Furthermore, the titanylphthalocyanine crystal having main peaks at 9.4°, 9.6° and 24.0°; a minimum diffraction peak at 7.3°; and preferably not having peaks at greater than 7.4° and less than 9.4° is more preferably used. Furthermore, the titanylphthalocyanine crystal not having a peak at 26.3° is most preferably used.

The CGL 35 can be formed by dispersing the above-mentioned pigment in a proper solvent optionally together with a binder resin using a ball mill, an attritor, a sand mill or a supersonic dispersing machine, coating the coating liquid on an electroconductive substrate and then drying the coated liquid. Suitable binder resins optionally used in the CGL 35 include polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinyl carbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. The content of the binder resin in the CGL 45 is preferably from 0 to 500 parts by weight, and preferably from 10 to 300 parts by weight per 100 parts by weight of the CGM.

Suitable solvents for use in the coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. The coating liquid can be coated by a coating method such as a dip coating method, a spray coating method, a bead coating method, a nozzle coating method, a spin coating method and a ring coating method. The thickness of the charge generation layer (35) is preferably from 0.01 to 5 μm, and more preferably from 0.1 to 2 μm.

The CTL 37 can be formed by dissolving or dispersing a CTM and a binder resin in a proper solvent, coating the dissolved or dispersed liquid on the charge generation layer and drying the coated liquid. Additives such as plasticizers, leveling agents and antioxidants may be included in the CTL if desired. The CTMs are classified into positive-hole transport materials and electron transport materials.

Specific examples of the electron transport materials include electron accepting materials such as chloranil,bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, etc. These CTMs can be used alone or in combination.

Specific examples of the binder resin include thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins and alkyd resins.

The CTM preferably has a content of from 20 to 300 parts by weight, and more preferably from 40 to 150 parts by weight per 100 parts by weight of the binder resin. The CTL preferably has a thickness of from about 5 to 100 μm. Suitable solvents for use in the coating liquid include tetrahydrofuran, dioxane, toluene, dichloromethane, monochlorobenzene, dichloroethane, cyclohexanone,methyl ethyl ketone, acetone and the like solvents. Particularly, a non-halide solvent is preferably used for the purpose of lessening the burden on the environment. Specific examples of the solvent include tetrahydrofuran, dioxolane, cyclic ethers such as dioxane, toluene, aromatic carbon hydrides such as xylene and their derivatives.

In addition, the CTL preferably includes a polymer CTM, which has both a binder resin function and a charge transport function, because the resultant CTL has good abrasion resistance. Suitable charge transport polymer materials include known polymer CTMs. Among these materials, polycarbonate resins having a triarylamine structure in their main chain and/or side chain are preferably used. In particular, polymer CTMs having the following formulae (I) to (X) are preferably used:

(I)

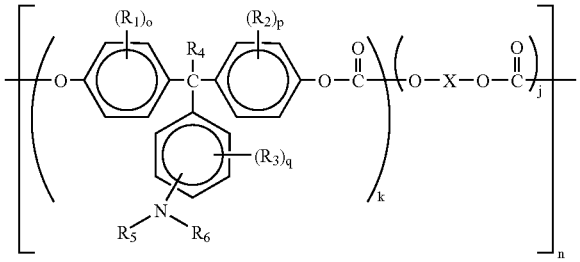

wherein, $R_1$, $R_2$ and $R_3$ independently represent a substituted or unsubstituted alkyl group; or a halogen atom; $R_4$ represents a hydrogen atom, or a substituted or unsubstituted alkyl group; $R_5$, and $R_6$ independently represent a substituted or unsubstituted aryl group; o, p and q independently represent 0 or an integer of from 1 to 4; k is a number of from 0.1 to 1.0 and j is a number of from 0 to 0.9; n represents a repeating number and is an integer of from 5 to 5000; and X represents a divalent aliphatic group, a divalent alicyclic group or a divalent group having the following formula:

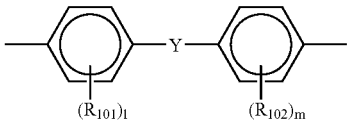

wherein, $R_{101}$ and $R_{102}$ independently represent a substituted or unsubstituted alkyl group, an aromatic ring group or a halogen atom; 1 and m represent 0 or an integer of from 1 to 4; and Y represents a direct bonding, a linear alkylene group, a branched alkylene group, a cyclic alkylene group, —O—, —S—, —SO—, —SO2-, —CO—, —CO—O-Z-O—CO— (Z represents a divalent aliphatic group), or a group having the following formula:

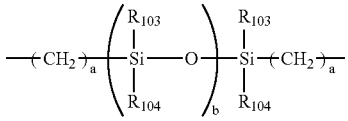

wherein, a is an integer of from 1 to 20; b is an integer of from 1 to 2000; and $R_{103}$ and $R_{104}$ independently represent a substituted or unsubstituted alkyl group, or a substituted or unsubstituted aryl group, and wherein $R_{101}$, $R_{102}$, $R_{103}$ and $R_{104}$ may be the same or different from the others;

(II)

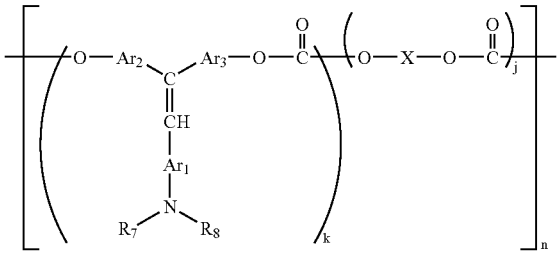

wherein, $R_7$ and $R_8$ represent a substituted or unsubstituted aryl group; $Ar_1$, $Ar_2$ and $Ar_3$ independently represent an arylene group; and X, k, j and n are the same as in formula (I);

(III)

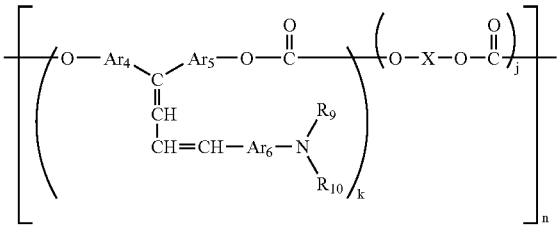

wherein, $R_9$ and $R_{10}$ represent a substituted or unsubstituted aryl group; $Ar_4$, $Ar_5$ and $Ar_6$ independently represent an arylene group; and X, k, j and n are the same as in formula (I);

(IV)

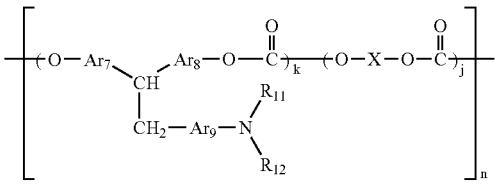

wherein, $R_{11}$ and $R_{12}$ represent a substituted or unsubstituted aryl group; $Ar_7$, $Ar_8$ and $Ar_9$ independently represent an arylene group; p is an integer of from 1 to 5; and X, k, j and n are the same as in formula (I);

(V)

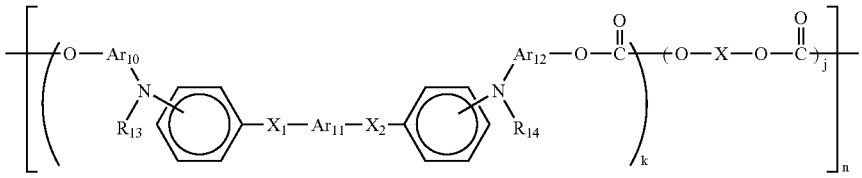

wherein, $R_{13}$ and $R_{14}$ represent a substituted or unsubstituted aryl group; $Ar_{10}$, $Ar_{11}$ and $Ar_{12}$ independently represent an arylene group; $X_1$ and $X_2$ represent a substituted or unsubstituted ethylene group, or a substituted or unsubstituted vinylene group; and X, k, j and n are the same as in formula (I);

(VI)

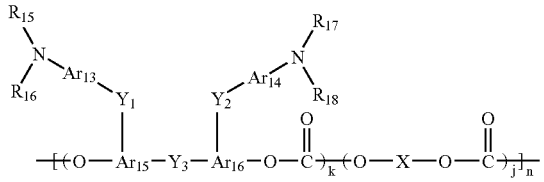

wherein, $R_{15}$, $R_{16}$, $R_{17}$ and $R_{18}$ represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a direct bonding, a substituted or unsubstituted alkylene group, a substituted or unsubstituted cycloalkylene group, a substituted or unsubstituted alkyleneether group, anoxygen atom, a sulfur atom, or a vinylene group; and X, k, j and n are the same as in formula (I);

(VII)

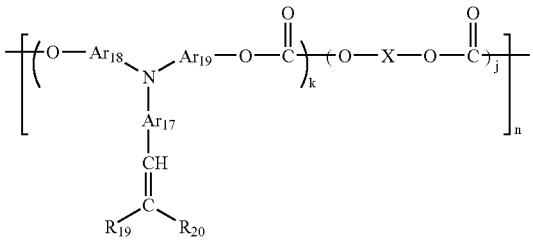

wherein, $R_{19}$ and $R_{20}$ represent a hydrogen atom, or substituted or unsubstituted aryl group, and $R_{19}$ and $R_{20}$ may form a ring; $Ar_{17}$, $Ar_{18}$ and $Ar_{19}$ independently represent an arylene group; and X, k, j and n are the same as in formula (I);

(VIII)

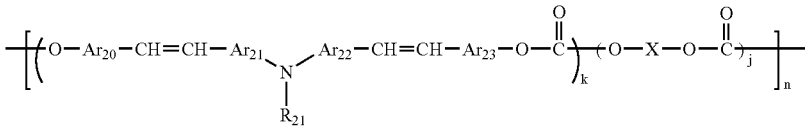

wherein, $R_{21}$, represents a substituted or unsubstituted aryl group; $Ar_{20}$, $Ar_{21}$, $Ar_{22}$ and $Ar_{23}$ independently represent an arylene group; and X, k, j and n are the same as in formula (I);

(IX)

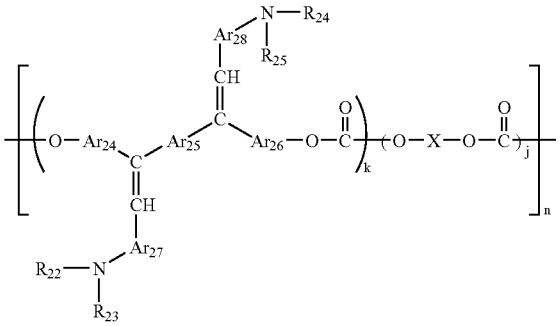

wherein, $R_{22}$, $R_{23}$, $R_{24}$ and $R_{25}$ represent a substituted or unsubstituted aryl group; $Ar_{24}$, $Ar_{25}$, $Ar_{26}$, $Ar_{27}$, and $Ar_{28}$ independently represent an arylene group; and X, k, j and n are the same as in formula (I);

(X)

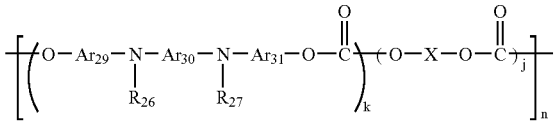

wherein, $R_{26}$ and $R_{27}$ independently represent a substituted or unsubstituted aryl group; $Ar_{29}$, $Ar_{30}$ and $Ar_{31}$ independently represent an arylene group; and X, k, j and n are the same as in formula (I).

In addition, other than the above-mentioned polymer CTMs, the polymer CTMs for use in the CTL include polymers finally having a two-dimensional or three-dimensional crosslinking structure, and which is formed from a monomer or an oligomer having an electron-releasing group when the CTL is formed and hardened or crosslinked after the CTL is formed.

The CTL comprised of these polymers having an electron-releasing group or a crosslinking structure has a good abrasion resistance. Usually, in an electrophotographic process, the charge potential (unexposed parts potential) is fixed, and when a surface of a photoreceptor is abraded due to repeated use, the electrical intensity increases in proportion to the abrasion. Accompanying the increase of the electrical intensity, the occurrence of background fouling increases, and therefore, a photoreceptor having a high abrasion resistance has the advantage of minimizing background fouling. The CTL comprised of these polymers having an electron-releasing group is easily coated because the CTL itself is a polymer compound. In addition, the CTL has good charge transportability because of having a higher-density charge transport portion than a CTL comprised of a polymer in which a low-molecular-weight compound is dispersed. Therefore, a high-speed response can be expected from a photoreceptor having a CTL using a polymer CTM.

Other polymers having an electron-releasing group include copolymers of known monomers, block polymers, graft polymers, star polymers and crosslinked polymers having an electron-releasing group disclosed in Japanese Laid-Open Patent Publications Nos. 3-109406, 2000-206723 and 2001-34001.

The CTL 37 in the present invention may include additives such as plasticizers and leveling agents. Specific examples of the plasticizers include known plasticizers, which are used for plasticizing resins, such as dibutyl phthalate and dioctyl phthalate. The quantity of the plasticizer added is 0 to 30% by weight of the binder resin. Specific examples of the leveling agents include silicone oils such as dimethyl silicone oil and methyl phenyl silicone oil; polymers or oligomers including a perfluoroalkyl group in their side chain; and the like. The quantity of the leveling agents added is 0 to 1% by weight of the binder resin.

In the photoreceptor of the present invention, an intermediate layer may be formed between the electroconductive substrate 31 and the photosensitive layer. The intermediate layer includes a resin as a main component. Since a photosensitive layer is typically formed on the intermediate layer by coating a liquid including an organic solvent, the resin in the intermediate layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins and epoxy resins. The intermediate layer may include a fine powder of metal oxides such as titanium oxide, silica, alumina, zirconium oxide, tin oxide and indium oxide to prevent the occurrence of moiré in the resultant images and to decrease the residual potential of the photoreceptor.

The intermediate layer can also be formed by coating a coating liquid using a proper solvent and a proper coating method similarly to those for use in formation of the photosensitive layer mentioned above. The intermediate layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the intermediate layer. The thickness thereof is preferably 0 to 5 μm.

In the photoreceptor of the present invention, a protection layer is optionally formed overlying the photosensitive layer. Recently, personal computers are used on a daily basis, and printers are required to produce images at a higher speed and to be reduced in size. Therefore, the photoreceptor of the present invention having high sensitivity without producing abnormal images and having improved durability with the protection layer can effectively be used.

In the photoreceptor of the present invention, a protection layer 39 is optionally formed overlying the photosensitive layer. Suitable materials for use in the protection layer 39 include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyarylate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, etc. Among these resins. polycarbonate resins or polyarylate resins are preferably used.

Other than these resins, the protection layer can include fluorocarbon resins such as polytetrafluoroethylene, silicone resins and materials comprised of these resins in which inorganic fillers such as titanium oxide, tin oxide, potassium titanate and silica or organic fillers are dispersed for the purpose of improving abrasion resistance thereof.

Specific examples of the organic fillers include powders of fluorocarbon resins such as polytetrafluoroethylene, silicone resin powders and α-carbon powders. Specific examples of the inorganic fillers include powders of metals such as copper, tin, aluminum and indium; metal oxides such as silica, tin oxide, zinc oxide, titanium oxide, indium oxide, antimony oxide, bismuth oxide, tin oxide doped with antimony, indium oxide doped with tin and potassium titanate. Among these fillers, inorganic fillers are preferably used in view of their hardness. In particular, silica, titanium oxide and alumina are preferably used.

Although the concentration of the filler in the protection layer depends on the kind of filler and electrophotographic process conditions using the resultant photoreceptor, the filler preferably is present at a concentration of from 5 to 50% by weight, and more preferably from 10 to 30% by weight based on the total weight of solid contents in the outermost surface of the protection layer.

In addition, the filler preferably has a volume-average particle diameter of from 0.1 to 2 μm, and more preferably from 0.3 to 1 ||m. When the average particle diameter is too small, the protection layer does not have sufficient abrasion resistance. When too large, the protection layer has a poor surface smoothness and cannot be formed in some cases.

The average particle diameter of the filler in the present invention is a volume-average particle diameter thereof unless otherwise specified, and is measured by an ultracentrifugal automatic particle-size-distribution measurer CAPA-700 from Horiba, Ltd. This is determined as a particle diameter which is equivalent to 50% of the cumulative distribution (Median value). Furthermore, it is important that the standard deviation of each particle measured at the same time is not greater than 1 μm. When the standard deviation is greater than 1 μm, the particle diameter distribution is so wide that the effect of the present invention is not occasionally exerted.

The pH of the filler largely affects the resolution of the resultant image and the dispersability of the filler. It is considered that one of the reasons for this is that hydrochloric acid and the like acid remain in the filler, particularly in a metal oxide filler. when the remaining amount of the acids is large, production of the resultant blurred images cannot be avoided, and the dispersability of the filler is occasionally influenced thereby depending on the remaining amount of acid.

The other reason is due to the difference of chargeability of the filler, particularly in a metal oxide filler. Usually, particles dispersed in a liquid are positively or negatively charged, and ions having an opposite charge gather to keep the particles neutral. Then, an electric double layer is formed to stabilize the dispersability of the particles. As the layer leaves the particles, the potential (zeta potential) gradually decreases and the potential of an electrically neutral area sufficiently apart from the particles becomes zero. Therefore, when the absolute value of the-zeta potential increases, the force of repulsion of the particles increases and the stability thereof increases. As the zeta potential becomes close to zero, the particles tend to agglomerate and become unstable.

On the other hand, depending on the pH of the dispersion liquid, the zeta potential fluctuates widely. The potential becomes zero at certain pH values and the dispersion liquid has an isoelectric point. Therefore, the particles are kept away from the isoelectric point as far as possible to stabilize the dispersion liquid.

In the present invention, the filler preferably has a pH at least not less 5 at the isoelectric point to prevent the resultant blurred images, and the effect increases when the filler is more basic. The dispersability and stability of a basic filler having a high pH improves when the dispersion liquid is acidic because the zeta potential increases more.

The pH values of the filler in the present invention are values from the zeta potential to isoelectric point, and the zeta potential is measured by a laser zeta electrometer from Otsuka Electronics Co., Ltd.

In order to prevent the occurrence of blurred images, fillers having a relatively high specific resistance of not less than $10^{10}$ Ω·cm are preferably used in the protection layer. In addition, fillers having a pH of not less than 5 or a dielectric constant of not less than 5 are preferably used. These fillers can be used alone or in combination. For example, a combination of two or more kinds of filler having a pH of not less than 5 and a filler having a pH of not greater than 5; or a combination of two or more kinds of filler having a dielectric constant of not less than 5 and a filler having a dielectric constant of not greater than 5 can be used. Among these fillers, α-form alumina, which has a hexagonal close-packed structure, is preferably used to improve the abrasion resistance of the resultant protection layer and to prevent the blurred image problem, because the alumina has a high insulation property, heat stability and good abrasion resistance.

The resistivity of the filler of the present invention is determined as follows. Because a powder like the filler has a different resistivity according to the filling factor, the resistivity has to be measured under fixed conditions. In the present invention, a measuring device having an equivalent structure to the measuring device disclosed in FIG. 1 of each of Japanese Laid-Open Patent Publications Nos. 5-94049 and 5-113688 is used to measure the resistivity of the filler.

The measuring device has an electrode area of 4.0 $cm^2$. The amount of sample is controlled such that the distance between the electrodes is 4 mm by applying a load of 4 kg to one of the electrodes for 1 min before measurements are made. The measurement is performed under conditions such that the upper electrode having a weight of 1 kg with an applied voltage of 100 V. A scope not less than $10^6$ Ω·cm is measured using a HIGH RESISTANCE METER from Yokogawa Hewlett Packard Ltd. and a scope less than that is measured using a Digital Multimeter from Fluke Corp.

The dielectric constant of the filler is measured as follows. A cell which is similar to that used in the measurement of resistivity is used, and capacitance is measured after a load is applied thereto to measure the dielectric constant. The capacitance is measure by a dielectric loss measuring device from Ando Electric Co., Ltd.

Furthermore, the fillers are preferably treated with at least one surface treating agent to improve the dispersability thereof. The deterioration of the dispersability of a filler included in the protection layer causes not only an increase of residual potential but also a decrease of transparency of the protection layer, generation of coating deficiencies and the deterioration of abrasion resistance. Therefore, a photoreceptor having good durability and capable of producing good images cannot be provided. Suitable surface treating agents include known surface treating agents, but surface treating agents which can maintain the insulating properties of the filler in the protection layer are preferably used. Specific examples of such surface treating agents include titanate coupling agents, aluminum coupling agents, zircoaluminate coupling agents, higher fatty acids, and combinations of these agents with silane coupling agents; and $Al_2O_3$, $TiO_2$, $ZrO_2$, silicones, aluminum stearate, and their mixtures. These are preferably used because they are capable of imparting good dispersability to fillers and preventing blurred images. When silane coupling agents are used, the blurred image problem tends to occur. However, when used in combination with the surface treating agents mentioned above, the problem can be avoided. The content of a surface treating agent in a coated filler, which depends on the primary particle diameter of the filler, is from 3 to 30% by weight, and more preferably from 5 to 20% by weight. When the content is too low, good dispersability cannot be obtained. To the contrary, when the content is too high, the residual potential significantly increases. These fillers can be used alone or in combination. The amount of the surface treatment of the filler is determined by the weight ratio of the surface treating agents to the amount of the filler.

The filler materials can be dispersed by a proper disperser. In addition, it is preferable that the filler is dispersed to primary particles and has less agglomerated bodies in respect to the transmittance of the protection layer.

The protection layer 39 may include a CTM to decrease residual potential and to improve the response of the resultant photoreceptor. The CTMs mentioned above for use in the CTL can be used. When a low-molecular-weight CTM is used in the protection layer, the concentration gradient of the low-molecular-weight CTM may be formed therein. In this case, it is preferable that the concentration of the CTM at the surface of the protection layer is lower than that at the bottom thereof to improve the abrasion resistance of the resultant photoreceptor. The concentration is the weight ratio of the low-molecular-weight CTM to the total weight of all of the materials included in the protection layer. The concentration gradient means a gradient that lowers the concentration of the CTM at the surface of protection layer.

In addition, using a charge transport polymer material is quite advantageous to increase the durability of the resultant photoreceptor. When the protection layer includes only the charge transport polymer material besides the filler, the resultant photoreceptor has not only high mechanical abrasion resistance but also high chemical stability. The charge transport polymer material has less chemical reactivity than the low-molecular-weight CTM and has high resistance against an oxide gas generated by the charger and a sputtering effect due to a discharge thereby. When a photoreceptor has a surface layer having a high abrasion resistance such as -a protection layer, blurred image problems due to a repeated use frequently occur. It is believed that this is due to adherence of the oxide gas and a low-resistance material to a surface of the photoreceptor. However, a protection layer including only the filler and the charge transport polymer material decreases the adherence site and exerts a high effect on the blurred image.

The protection layer is formed by a conventional coating method. The protection layer preferably has a thickness of from 0.1 to 10 μm. In addition, a protection layer formed by a vacuum thin film forming method using known materials such as α-C and α-SiC can be used.

As mentioned above, a photosensitive layer (CTL)including a polymer CTM or a protection layer formed on a surface of a i photoreceptor not only increases durability (abrasion resistance) of the photoreceptor but also exerts a new effect when used in a tandem-type full-color image forming apparatus, which is not available in a monochrome image forming apparatus. In the full-color image forming apparatus, various modes of images are input and formulaic images are also input, e.g., proof marks in Japanese documents. Such proof marks are usually located at the edges of the images and the colors are limited. Furthermore, a tandem-type full-color image forming apparatus prevails and the printing speed thereof improves, and many business documents having, e.g., a company logo are produced. In such a case, a specific part is repeatedly printed and the uneven use of the photoreceptor becomes large. When random images are always written in a photoreceptor, image writing, development and transfer are performed thereon on average. When images are repeatedly written in a specific part of the photoreceptor or only specific image forming elements thereof are used, the balance of durability thereof is lost. When a photoreceptor does not have so (physically, chemically and mechanically) durable a surface in such conditions, the balance loss becomes large and causes image problems. On the other hand, a photoreceptor having a high durability has less local loss and produces less defective images.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, synthesis examples of the CGM used in the present invention will be explained.

Synthesis Example 1

29.2 g of 1,3-diiminoisoindoline and 200 ml of sulfolane were mixed, and 20.4 g of titaniumtetrabutoxide were dropped into the mixture under a nitrogen gas stream. The mixture was gradually heated until the mixture had a temperature of 180° C. and was stirred for 5 hrs while the reaction temperature was maintained from 170 to 180° C. After the mixture was cooled, a precipitated material (powder) was filtered and washed with chloroform until the powder became blue. Next, the powder was washed with methanol several times, and further washed with hot water having a temperature of 80° C. several times to provide a crude titanylphthalocyanine pigment. The crude titanylphthalocyanine pigment was mixed in concentrated sulfonic acid which was present in an amount of 20 times as much as the amount of crude titanylphthalocyanine pigment and stirred to dissolve the pigment therein. The mixture was then dropped in ice water, which was present in an amount of 100 times as much as the mixture, while stirring, and a precipitated crystal was filtered. Then, the crystal was repeatedly washed with water until the water became neutral, to provide a wet cake of a titanylphthalocyanine pigment. 2 g of the wet cake was included in 20 g of tetrahydrofuran and the mixture was stirred for 4 hrs. After 100 g of methanol was included in the mixture and the mixture was stirred for 1 hr, the mixture was filtered and dried to provide the titanylphthalocyanine powder of the present invention.

An X-ray diffraction spectrum of the titanylphthalocyanine powder was measured under the following conditions to determine that the titanylphthalocyanine powder has at least a maximum diffraction peak at a Bragg (2θ) angle of 27.2±0.2°; a minimum diffraction peak at 7.3°; and not having peaks at greater than 7.4° and less than 9.4° when irradiated with a specific X-ray of CuKα having a wavelength of 1.542 Å.

X-ray tube: Cu

Voltage: 40 kV

Current: 20 mA

Scanning speed: 1°/min

Scanning range: 3 to 40°

Time constant: 2 sec

The result is shown in FIG. 7.

Figure 13:
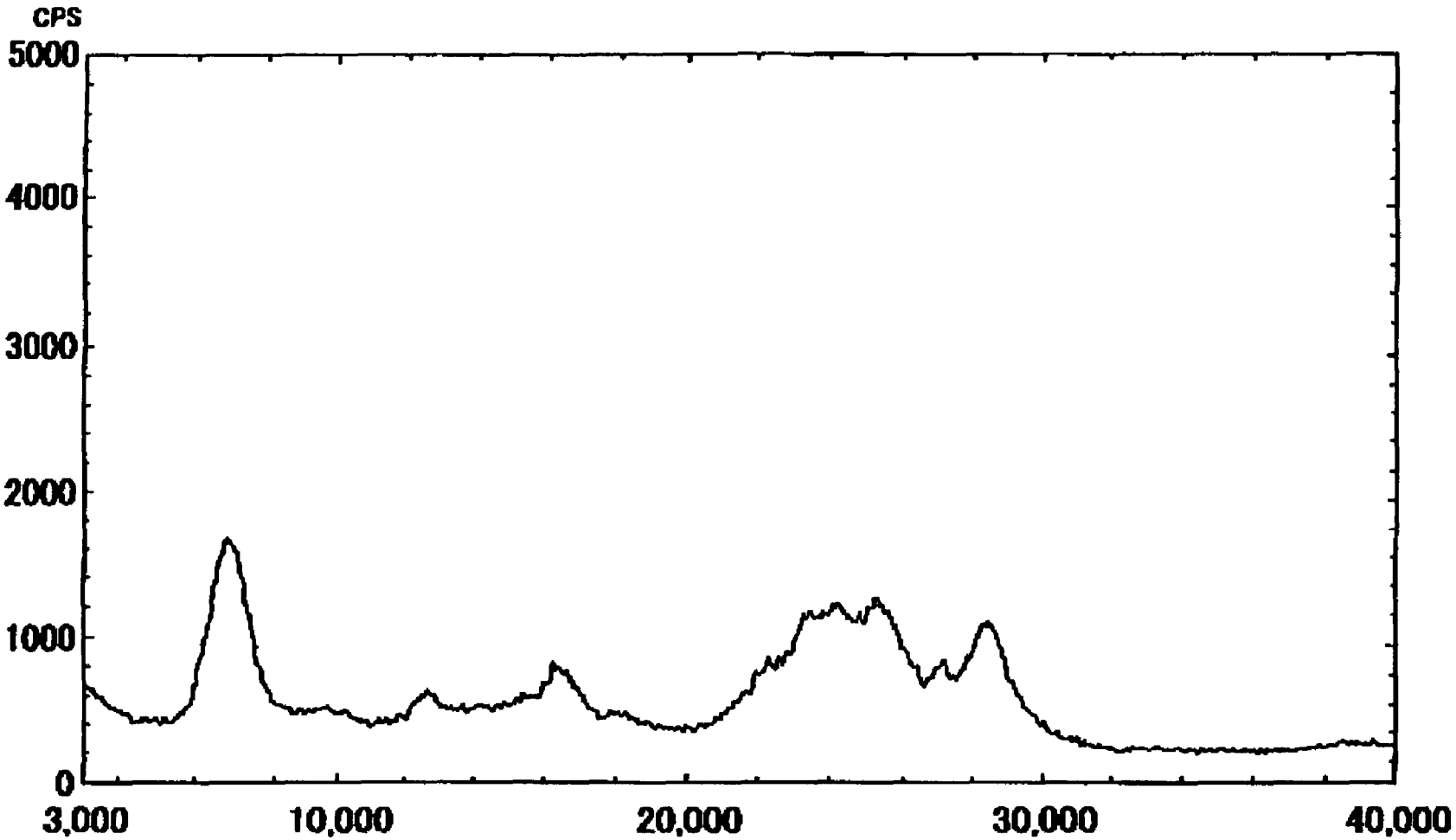
FIG. 13 is a diagram showing an X-ray spectrum of a water paste of the low-crystallinity titanylphthalocyanine dry powder of the present invention.

In addition, a portion of the water paste prepared in Synthesis Example 1 was dried for 2 days at 80° C. under reduced pressure (5 mm HG) to prepare a low-crystallinity titanylphthalocyanine powder. The X-ray diffraction spectrum of the dry powder of the water paste is shown in FIG. 13.

Synthesis Example 2

A pigment was prepared in accordance with the method disclosed in Example 1 in Japanese Laid-Open Patent Publication No. 1-299874 (Japanese patent No. 2512081). Namely, the wet cake prepared in Synthesis Example 1 was dried and 1 g of the dried material was included in 50 g of polyethylene glycol. The mixture was dispersed by a sand mill for 1 hr with 100 g of glass beads. After the crystal conversion, the dispersed material was washed with a diluted sulfuric acid and an aqueous solution of ammonium hydroxide in this order, and dried to provide a pigment. This is Pigment 7.

Synthesis Example 3

A pigment was prepared in accordance with the method disclosed in Production Example 1 in Japanese Laid-Open Patent Publication No. 3-269064 (Japanese Patent No.2584682). Namely, the wet cake prepared in Synthesis Example 1 was dried, and after 1 g of the dried material was stirred in a mixed solvent of 10 g of ion exchange water and 1 g of monochlorobenzene for 1 hr at 50° C., the mixture was washed with methanol and ion exchange water and dried to provide a pigment.

Synthesis Example 4

A pigment was prepared in accordance with the method disclosed in the production Example in Japanese Laid-Open Patent Publication No. 2-8256 (Japanese Patent Publication No. 7-91486). Namely, 9.8 g of phthalodinitrile and 75 ml of 1-chloronaphthalene were mixed and stirred, and 2.2 ml of titanium tetrachloride was dropped in the mixture under a nitrogen gas stream. The mixture was gradually heated to a temperature of 200° C. and stirred for 3 hrs while the reaction temperature was maintained at 200 to 220° C. Then, the mixture was cooled to a temperature of 130° C. and filtered to prepare a powder. After the powder was washed to a blue color with 1-chloronaphthalene, methanol for several times and hot water having a temperature of 80° C. for several times, the powder was dried to provide a pigment.

Synthesis Example 5

A pigment was prepared in accordance with the method disclosed in Synthesis Example 1 in Japanese Laid-Open Patent Publication No. 64-17066 (Japanese Patent Publication No. 7-97221). Namely, 5 parts of α-type TiOPc was subjected to a crystal conversion treatment in a sand grinder with 10 g of salt and 5 g of acetophenone at 100° C. for 10 hrs. The mixture was washed with ion exchange water and methanol and refined with an aqueous solution of a diluted sulfuric acid. Then, the mixture was washed with ion exchange water again until it did not have any acid content, and dried to provide a pigment.

Synthesis Example 6

A pigment was prepared in accordance with the method disclosed in Example 1 in Japanese Laid-Open Patent Publication No. 11-5919 (Japanese Patent No. 3003664). Namely, after 20.4 parts of o-phthalodinitrile and 7.6 parts of titanium tetrachloride were heated in 50 parts of quinoline at 200° C. for 2 hrs, the solvent was removed from the mixture by a steam distillation. The mixture was refined with an aqueous chloride solution having a concentration of 2% and an aqueous sodium hydroxide solution having a concentration of 2%. Then, the mixture was washed with methanol and N,N-dimethylformamide, and dried to provide 21.3 parts of titanylphthalocyanine. 2 parts of the titanylphthalocyanine were gradually dissolved in 40 parts of sulfuric acid having a concentration of 98% and a temperature of 5° C., and the mixture was stirred for about 1 hr while a temperature of 5° C. was maintained. Then, the mixture was slowly included in 400 parts of ice water in which sulfuric acid was mixed and stirred at a high speed, and precipitated crystals were filtered. The crystals were washed with distilled water until they did not have an acid content, to provide a wet cake. The wet cake including a presumed content of 2 parts of phthalocyanine was stirred in 100 parts of tetrahydrofuran for about 5 hrs. The mixture was filtered, washed and dried to provide a pigment.

Synthesis Example 7

A pigment was prepared in accordance with the method disclosed in Synthesis Example 2 in Japanese Laid-Open Patent Publication No. 3-255456 (Japanese Patent No.3005052). Namely, 10 parts of the wet cake prepared in Synthesis Example 1 were mixed with 15 parts of sodium chloride and 7 parts of diethyleneglycol, and the mixture was milled in an automatic mortar for 60 hrs with the application of heat at 80° C. Next, the mixture was sufficiently washed with water to completely remove the sodium chloride and diethyleneglycol included therein. After the mixture was dried under reduced pressure, 200 parts of cyclohexanone and glass beads having a diameter of 1 mm were included therein, and the mixture was milled with a sand mill for 30 min to provide a pigment.

Synthesis Example 8

According to the method of Synthesis Example 1, a water paste of the titanylphthalocyanine pigment was synthesized, and crystals of the water paste were converted by the following method to provide phthalocyanine crystals having a smaller primary particle diameter than that of Synthesis Example 1.

1,500 parts of tetrahydrofuran were included in 60 parts of the water paste of Synthesis Example 1, before the crystal conversion according to Synthesis Example 1 was carried out, and the mixture was strongly stirred by a homomixer (MARK II f model from Kenneth) at room temperature and 2000 rpm, until the paste changed its color from navy blue to pale blue (20 minutes after the stirring started). Then, stirring was stopped and the mixture was immediately filtered under reduced pressure. Crystals isolated on the filtration equipment were washed with tetrahydrofuran to prepare a wet cake of pigment. The wet cake was dried for 2 days at 70° C. under reduced pressure (5 mm HG) to provide 58 parts of titanylphthalocyanine crystals.

A portion of the titanylphthalocyanine (water paste) before crystal conversion was carried out as in Synthesis Example 1, was diluted with ion exchange water to a concentration of 1% by weight. The surface of the diluted titanylphthalocyanine was scooped with a copper net having an electroconductive surface, and the particle size of thetitanylphthalocyanine thus isolated was observed with a transmission electron microscope (TEM), Model H-9000NAR from Hitachi, Ltd., at a magnification of 75,000. The average particle size was determined as follows:

The TEM image was photographed and 30 titanylphthalocyanine particles having the shape of a needle were randomly selected to measure the respective longer diameters. An arithmetic average of the 30 longer diameters was determined to be the average particle size.

The average particle size determined by this method, in the water paste of Synthesis Example 1 was 0.06 μm.

The titanylphthalocyanine crystals after crystal conversion, and just before being filtered as in Synthesis Examples 1 and 8, were diluted with tetrahydrofuran to a concentration of 1% by weight, and the diluted crystals were observed by the same method as mentioned above. The average particle sizes are shown in Table 1. All of the titanylphthalocyanine crystals prepared in Synthesis Examples 1 and 8 did not have similar shapes, and had approximately the shape of triangles, quadrangles, etc. Therefore, the longest diagonals of the crystals were regarded as the long diameters.

TABLE 1

| | Average particle size (μm) | Remarks |
|---|---|---|
| Synthesis Example 1 | 0.31 | Large particles having a diameter of from about 0.3 to 0.4 μm were included. |
| Synthesis Example 8 | 0.12 | The crystal sizes were nearly uniform. |

X-ray diffraction spectra of pigments prepared in Synthesis Examples 2 to 7 were measured by the same method as in Synthesis Example 1 to determine that they have the same spectra disclosed in the respective publications. The X-ray diffraction spectrum of the pigment prepared in Synthesis Example 8 was same as that of the pigment prepared in Synthesis Example 1. Table 2 shows the X-ray diffraction spectra and peak positions of the respective pigments.

TABLE 2

| | Max. Peak | Min. Peak | 9.4° Peak | 9.6° Peak | Peak from 7.4 to 9.4° | 26.3° Peak |
|---|---|---|---|---|---|---|
| Syn Ex. 1 | 27.2° | 7.3° | Available | Available | Not Available | Not Available |
| Syn. Ex. 2 | 27.2° | 7.3° | Not Available | Not Available | Not Available | Not Available |
| Syn. Ex. 3 | 27.2° | 9.6° | Available | Available | Not Available | Not Available |
| Syn. Ex. 4 | 27.2° | 7.4° | Not Available | Available | Not Available | Not Available |
| Syn. Ex. 5 | 27.2° | 7.3° | Available | Available | Available (7.5°) | Not Available |
| Syn. Ex. 6 | 27.2° | 7.5° | Not Available | Available | Available (7.5°) | Not Available |
| Syn. Ex. 7 | 27.2° | 7.4° | Not Available | Not Available | Available (9.2°) | Available |
| Syn. Ex. 8 | 27.2° | 7.3° | Available | Available | Not Available | Not Available |

Photoreceptor Production Example 1

An undercoat layer coating liquid, a CGL coating liquid and CTL coating liquid having the following components were coated and dried in this order on an aluminium cylinder having adiameterof 60 mm (JIS1050) as a substrate to prepare amultilayer photoreceptor having an undercoat layer 3.5 μm thick, a CGL and a CTL 25 μm thick. The CGL had a thickness so as to have a light transmittance of 20% for light having a wavelength of 780 nm. The transmittance was measured by a UV-3100 spectrophotometer from Shimadzu Corp. with light having a wavelength of 780 nm for an aluminium cylinder wound with a polyethyleneterephthalate film and coated with the following CGL coating liquid, and a polyethyleneterephthalatefilm not coated with the CGL coating liquid.

Undercoat Layer Coating Liquid

| | |
|---|---|
| Titanium oxide<br>(CR-EL from Ishihara Sangyo Kaisha, ltd.) | 70 |
| Alkyd resin<br>(Bekkolite M6401-50-S (solid content 50%)<br>from Dainippon Ink And Chemicals, inc.) | 15 |
| Melamine resin<br>(Super Bekkamin L-121-60 (solid content 60%)<br>from Dainippon Ink And Chemicals, inc.) | 10 |
| 2-butanone | 100 |

CGL Coating Liquid

The following components were dispersed with a commercial beads mill disperser using a PSZ ball having a diameter of 0.5 mm at a rotor revolution speed at 1,500 rpm for 30 min.

| | |
|---|---|
| Titanylphthalocyanine crystal<br>prepared in Synthesis Example 1 | 15 |
| Polyvinylbutyral<br>(BX-1 from Sekisui Chemical Co., Ltd.) | 10 |
| 2-butanone | 280 |

The particle diameter distribution of the pigment in this dispersion liquid was measured with a CAPA-700 from Horiba, Ltd. The average particle diameter was 0.29 μm and the standard deviation was 0.18 μm.

CTL Coating Liquid

| | |
|---|---|
| Polycarbonate<br>(TS2050 from Teijin Chemicals Ltd.) | 10 |
| CTM having the following formula | 7 |

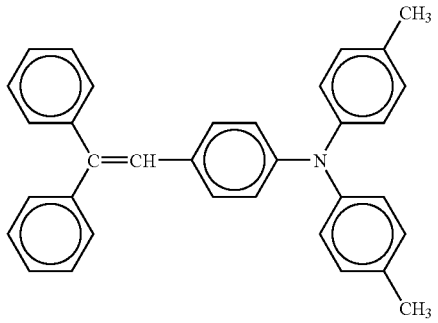

| | |
|---|---|
| Methylene chloride | 80 |

Photoreceptor Production Examples 2 to 8

The procedures for preparation of the photoreceptor in i Photoreceptor Production Example 1 were repeated to prepare photoreceptors in Photoreceptor Production Examples 2 to 8 except for changing the titanylphthalocyanine pigment for use in the CGL coating liquid (prepared in Synthesis Example 1) to the titanylphthalocyanine pigments prepared in Synthesis Examples 2 to 8. The CGLs had a thickness so as to have alight transmittance of 20% for light having a wavelength of 780 nm as the CGL in Photoreceptor Production Example 1 did.

Photoreceptor Production Example 9

The procedures for preparing the photoreceptor in Photoreceptor Production Example 1 were repeated to provide a photoreceptor except the CGL coating liquid was filtered with the application of pressure by a pump before coating with a cotton wind cartridge filter TCW-3-CS having an effective pore diameter of 3 μm from Advantech Co., Ltd.

Photoreceptor Production Example 10

The procedures for preparing the photoreceptor in Photoreceptor Production Example 1 were repeated to provide a photoreceptor except the CGL coating liquid was filtered with the application of pressure by a pump before coating with a cotton wind cartridge filter TCW-1-CS having an effective pore diameter of 1 μm from Advantech Co., Ltd.

Photoreceptor Production Example 11

The procedures for preparing the photoreceptor in Photoreceptor Production Example 1 were repeated to provide a photoreceptor except for filtering the CGL coating liquid upon application of pressure by a pump before coating with a cotton wind cartridgefilter TCW-5-CS having an effective pore diameter of 5 μm from Advantech Co., Ltd.

Examples 1 to 5 and Comparative Examples 1 to 17

The thus prepared electrophotographic photoreceptors in Photoreceptor Production Examples 1 to 7 were installed in the electrophotographic image forming apparatus in FIG. 1, which uses a LD having a wavelength of 780 nm as an imagewise light irradiator (with a polygon mirror), a contact charging roller as a charger and a transfer belt as a transfer member, and 200,000 images of a chart having a written part of 6% were continuously produced to evaluate hollow images and background fouling thereof in the following charging and transfer conditions under an environment of 22° C. and 55% RH. The transfer current was controlled with the circuit as shown in FIG. 12. The evaluation was classified to four grades, i.e., ◎ represents very good, O represents good, Δ represents slightly poor and x represents very poor. The results are shown in Table 3.

DC bias: −900 V

AC bias: 2.0 kV (peak to peak)

Frequency: 1.5 kHz

Transfer conditions: 75 μA and 60 μA

TABLE 3

| | Photo-receptor | Pigment | Transfer current (μA) | Image Evaluation: Hollow images | Image Evaluation: Background fouling |
|---|---|---|---|---|---|
| Ex. 1 | Prod. Ex. 1 | Syn. Ex. 1 | 75 | ○ | ○ |
| Ex. 2 | Prod. Ex. 8 | Syn. Ex. 8 | 75 | ○ | ◎ |
| Ex. 3 | Prod. Ex. 9 | Syn. Ex. 1 | 75 | ○ | ◎ |
| Ex. 4 | Prod. Ex. 10 | Syn. Ex. 1 | 75 | ○ | ◎ |
| Ex. 5 | Prod. Ex. 11 | Syn. Ex. 1 | 75 | ○ | ○ |

TABLE 3-continued

| | Photo-receptor | Pigment | Transfer current (μA) | Image Evaluation Hollow images | Image Evaluation Background fouling |
|---|---|---|---|---|---|
| Com. Ex. 1 | Prod. Ex. 2 | Syn. Ex. 2 | 75 | ○ | X |
| Com. Ex. 2 | Prod. Ex. 3 | Syn. Ex. 3 | 75 | ○ | X |
| Com. Ex. 3 | Prod. Ex. 4 | Syn. Ex. 4 | 75 | ○ | X |
| Com. Ex. 4 | Prod. Ex. 5 | Syn. Ex. 5 | 75 | ○ | X |
| Com. Ex. 5 | Prod. Ex. 6 | Syn. Ex. 6 | 75 | ○ | X |
| Com. Ex. 6 | Prod. Ex. 7 | Syn. Ex. 7 | 75 | ○ | X |
| Com. Ex. 7 | Prod. Ex. 1 | Syn. Ex. 1 | 60 | X | ○ |
| Com. Ex. 8 | Prod. Ex. 2 | Syn. Ex. 2 | 60 | X | Δ |
| Com. Ex. 9 | Prod. Ex. 3 | Syn. Ex. 3 | 60 | X | X |
| Com. Ex. 10 | Prod. Ex. 4 | Syn. Ex. 4 | 60 | X | X |
| Com. Ex. 11 | Prod. Ex. 5 | Syn. Ex. 5 | 60 | X | Δ |
| Com. Ex. 12 | Prod. Ex. 6 | Syn. Ex. 6 | 60 | X | Δ |
| Com. Ex. 13 | Prod. Ex. 7 | Syn. Ex. 7 | 60 | X | X |
| Com. Ex. 14 | Prod. Ex. 8 | Syn. Ex. 8 | 60 | X | ◎ |
| Com. Ex. 15 | Prod. Ex. 9 | Syn. Ex. 1 | 60 | X | ◎ |
| Com. Ex. 16 | Prod. Ex. 10 | Syn. Ex. 1 | 60 | X | ◎ |

TABLE 3-continued

| | Photo-receptor | Pigment | Transfer current (μA) | Image Evaluation Hollow images | Image Evaluation Background fouling |
|---|---|---|---|---|---|
| Com. Ex. 17 | Prod. Ex. 11 | Syn. Ex. 1 | 60 | X | ○ |

Photoreceptor Production Example 12

The procedures for preparing the photoreceptor in Photoreceptor Production Example 1 were repeated except for changing the CTL coating liquid to a CTL coating liquid having the following components to provide a photoreceptor.

CTL Coating Liquid

| | |
|---|---|
| Polymer CTM having the following formula and an approximate weight-average molecular weight of 135,000 | 10 |

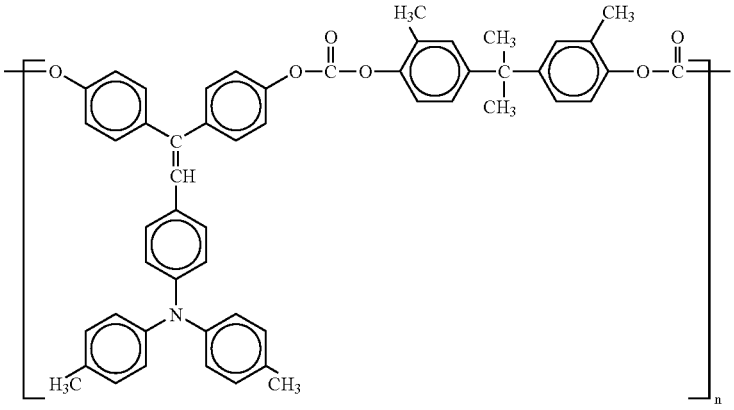

| | |
|---|---|
| Additive having the following formula | 0.5 |

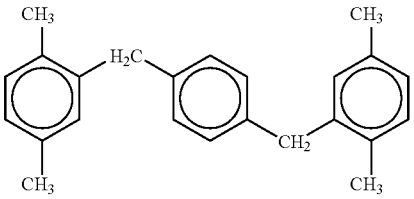

| | |
|---|---|
| Methylene chloride | 100 |
| Additive having the following formula | 0.5 |

-continued

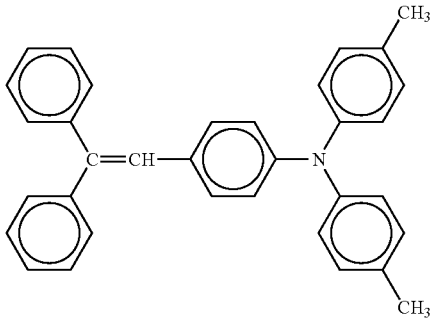

| | |
|---|---|
| Methylene chloride | 100 |

Photoreceptor Production Example 13

The procedures for preparing the photoreceptor in Photoreceptor Production Example 1 were repeated except that the thickness of the CTL was changed to 20 μm and a protection layer coating liquid having the following components was coated and dried on the CTL to form a protection layer having a thickness of 5 μm thereon.

Protection Layer Coating Liquid

| | |
|---|---|
| Polycarbonate (TS2050 from Teijin Chemicals Ltd.) | 10 |
| CTM having the following formula | 7 |

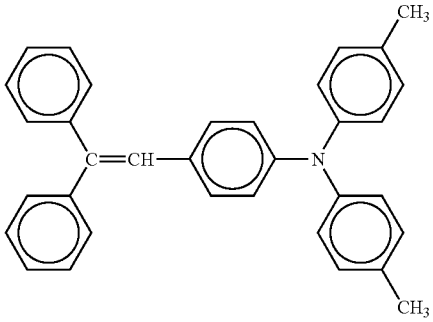

| | |
|---|---|
| Alumina fine particles having a resistivity of $2.5 \times 10^{12}$ Ω · cm and an average primary particle diameter of 0.4 μm | 4 |
| Cyclohexanone | 500 |
| Tetrahydrofuran | 150 |

Photoreceptor Production Example 14

The procedures for preparing the photoreceptor in Photoreceptor Production Example 9 were repeated except for changing the alumina fine particles to titanium oxide fine particles having a resistivity of $1.5\times10^{10}$ Ω·cm and an average primary particle diameter of 0.5 μm.

Photoreceptor Production Example 15

The procedures for preparing the photoreceptor in Photoreceptor Production Example 9 were repeated except for changing the alumina fine particles to tin-antimony oxide powder having a resistivity of $10^6$ Ω·cm and an average primary particle diameter of 0.4 μm.

Photoreceptor Production Example 16

The procedures for preparing the photoreceptor in Photoreceptor Production Example 1 were repeated to provide a photoreceptor except that the aluminium cylinder (JIS1050) was subjected to the following anodic oxide coating without forming the undercoat layer.

Anodic Oxide Coating

A surface of the cylinder was polished to provide a mirror finished surface, and degreasing cleaning and water washing were performed on the cylinder. Then, the cylinder was dipped in an electrolyte including 15% by volume sulfuric acid and having a temperature of 20° C. to perform an anodic oxide coating at a bath voltage of 15 V for 30 min. Further, the cylinder was washed with water and sealed with an aqueous solution of nickel acetate (50° C.) having a concentration of 7%. Then, the cylinder was washed with purified water to provide a substrate having an anodic oxide coated layer having a thickness of 7 μm.

Examples 6 to 14 and Comparative Examples 18 to 23

The thus prepared photoreceptors in Photoreceptor Production Examples 1 to 16 were installed in the electrophotographic image forming apparatus in FIG. 1, which uses a LD having a wavelength of 780 nm as an imagewise light irradiator (with a polygon mirror) and a charger located closely to the photoreceptor in FIG. 2 (a gap therebetween was 50 μm), which was a charging roller having a wound insulative tape 50 μm thick at both ends thereof. 200,000 images of a chart having a written part of 6% were continuously produced to evaluate background fouling and halftone images thereof in the following charging and transfer conditions under an environment of 22° C. and 55% RH. The transfer current was controlled with the circuit as shown in FIG. 12. The results of the background fouling was classified into four grades, i.e., ◎ represents very good, O represents good, Δ represents slightly poor and x represents very poor. In addition, abrasion amounts of photosensitive layers (protection layers if any) of the photoreceptors were measured after 200,000 mages were produced. The results are shown in Table 4.

DC bias: approximately −900 V

AC bias: 2.0 kV (peak to peak)

Frequency: 1.5 kHz

Transfer conditions: 90 μA

TABLE 4

| | Photo-Receptor | Background fouling | Halftone image | Abrasion Amount (μm) |
|---|---|---|---|---|
| Ex. 6 | Prod. Ex. 1 | ○ | Good | 5.9 |
| Com. Ex. 18 | Prod. Ex. 2 | X | Image density deteriorated | 5.9 |
| Com. Ex. 19 | Prod. Ex. 3 | X | Image density deteriorated | 5.9 |
| Com. Ex. 20 | Prod. Ex. 4 | X | Image density deteriorated | 5.9 |
| Com. Ex. 21 | Prod. Ex. 5 | X | Image density deteriorated | 5.9 |
| Com. Ex. 22 | Prod. Ex. 6 | X | Image density deteriorated | 5.9 |
| Com. Ex. 23 | Prod. Ex. 7 | X | Image density deteriorated | 5.9 |
| Ex. 7 | Prod. Ex. 8 | ◎ | Good | 5.9 |
| Ex. 8 | Prod. Ex. 9 | ◎ | Good | 5.9 |
| Ex. 9 | Prod. Ex. 10 | ◎ | Good | 5.9 |
| Ex. 10 | Prod. Ex. 11 | ○ | Good | 5.9 |
| Ex. 11 | Prod. Ex. 12 | ○ | Good | 3.7 |
| Ex. 12 | Prod. Ex. 13 | ○ | Good | 2.5 |
| Ex. 13 | Prod. Ex. 14 | ○ | Good | 2.3 |
| Ex. 14 | Prod. Ex. 15 | ○ | Image slightly blurred | 2.5 |
| Ex. 15 | Prod. Ex. 16 | ○~◎ | Good | 5.9 |

Example 16

A halftone image was produced in an environment of 30° C. and 90% RH to evaluate the image after 200,000 images were produced in Example 6.

Example 17

The charging member closely located to the photoreceptor in Example 2 was changed to a scorotron charger and the surface potential of a non-image forming part of the photoreceptor was set at −900 V as it was in Example 6. Then, a halftone image was produced in an environment of 30° C. and 90% RH to evaluate the image after 200,000 images were produced as it was in Example 15.

Example 18

The charging member closely located to the photoreceptor in Example 6 was changed to a contact charger (without a gap between the charger and the photoreceptor). Then, a halftone image was produced in an environment of 30° C. and 90% RH to evaluate the image after 200,000 images were produced as it was in Example 16.

Example 19

The procedures of evaluation for the image in Example 18 were repeated except for changing the charging conditions as follows:

DC bias: −1600 V (the initial surface potential of a non-image forming part of the photoreceptor was −900 V)

AC bias: None

Example 20

The procedures for evaluating the image in Example 6 were repeated except for changing the charging conditions as follows:

DC bias: −1600 V (the initial surface potential of a non-image forming part of the photoreceptor was −900 V)

AC bias: None

Then, a halftone image was produced in an environment of 30° C. and 90% RH to evaluate the image after 200,000 images were produced as it was in Example 16.

Example 21

The procedures for evaluating the image in Example 6 were repeated except for changing the gap between the charging member and the photoreceptor to 100 μm. A halftone image was produced in an environment of 30° C. and 90% RH to evaluate the image after 200,000 images were produced as it was in Example 16.

Example 22

The procedures for evaluating the image in Example 6 were repeated except for changing the gap between the charging member and the photoreceptor to 150 μm. A halftone image was produced in an environment of 30° C. and 90% RH to evaluate the image after 200,000 images were produced as it was in Example 16.

Example 23

The procedures for evaluating the image in Example 16 were repeated except for changing the gap between the charging member and the photoreceptor to 250 μm. A halftone image was produced in an environment of 30° C. and 90% RH to evaluate the image after 200,000 images were produced as it was in Example 16.

Example 24

In Example 7, a halftone image was produced in an environment of 30° C. and 90% RH to evaluate the image after 200,000 images were produced.

Example 25

In Example 8, a halftone image was produced in an environment of 30 t and 90% RH to evaluate the image after 200,000 images were produced.

Evaluation results of Examples 16 to 25 are shown in Table 5.

TABLE 5

| | Image Evaluation (22° C.-55% RH) | | Halftone image | |
|---|---|---|---|---|
| | Background fouling | Halftone image | (22° C.-90% RH) | Remarks |
| Ex. 16 | ○ | Good | Good | |
| Ex. 17 | ○ | Very slight blurred image | Slight blurred image | Ozone very smelled |
| Ex. 18 | ○ | Very slight uneven image density | Very slight uneven image density | Charging roller was contaminated |
| Ex. 19 | ○ | Slight uneven image density | Slight uneven image density | Charging roller was contaminated |
| Ex. 20 | ○ | Slight even image density | Slight even image density | |

TABLE 5-continued

| | Image Evaluation (22° C.-55% RH) | | Halftone image | |
|---|---|---|---|---|
| | Background fouling | Halftone image | (22° C.-90% RH) | Remarks |
| Ex. 21 | ○ | Good | Good | |
| Ex. 22 | ○ | Good | Good | |
| Ex. 23 | ○ | Slight even image density | Slight even image density | |
| Ex. 24 | ◎ | Good | Good | |
| Ex. 25 | ◎ | Good | Good | |

Photoreceptor Production Example 17

The procedures for preparing the photoreceptor in Photoreceptor Production Example 1 were repeated except for changing the CTL coating liquid to a CTL coating liquid having the following components to provide a photoreceptor.

CTL Coating Liquid

| | |
|---|---|
| Polycarbonate (TS2050 from Teijin Chemicals Ltd.) | 10 |
| CTM having the following formula | 7 |

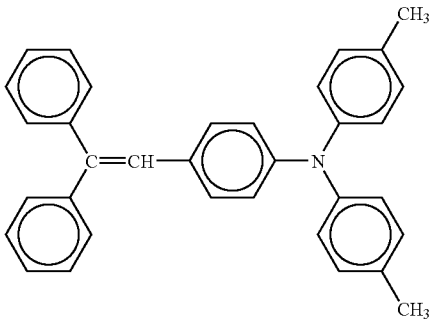

| | |
|---|---|
| Tetrahydrofuran | 80 |

Photoreceptor Production Example 18

The procedures for preparing the photoreceptor in Photoreceptor Production Example 6 were repeated except for changing the CTL coating liquid to a CTL coating liquid having the following components to provide a photoreceptor.

CTL Coating Liquid

| | |
|---|---|
| Polycarbonate (TS2050 from Teijin Chemicals Ltd.) | 10 |
| CTM having the following formula | 7 |

-continued

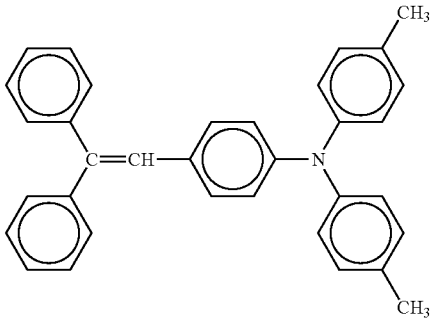

| | |
|---|---|
| Tetrahydrofuran | 80 |

Photoreceptor Production Example 19

The procedures for preparing the photoreceptor in Photoreceptor Production Example 1 were repeated except for changing the CTL coating liquid to a CTL coating liquid having the following components to provide a photoreceptor.

CTL Coating Liquid

| | |
|---|---|
| Polycarbonate (TS2050 from Teijin Chemicals Ltd.) | 10 |
| CTM having the following formula | 7 |

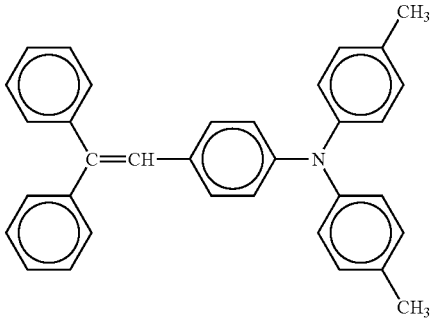

| | |
|---|---|
| Dioxolane | 80 |

Photoreceptor Production Example 20

The procedures for preparing the photoreceptor in Photoreceptor Production Example 1 were repeated except for changing the CTL coating liquid to a CTL coating liquid having the following components to provide a photoreceptor.

CTL Coating Liquid

| | |
|---|---|
| Polycarbonate (TS2050 from Teijin Chemicals Ltd.) | 10 |
| CTM having the following formula | 7 |

-continued

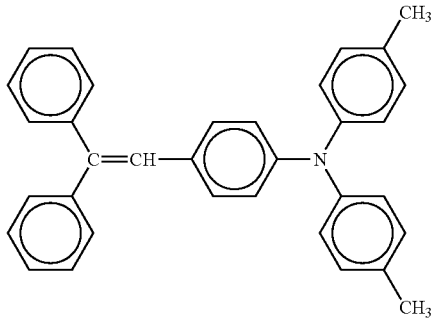

| | |
|---|---|
| Tetrahydrofuran | 40 |
| Toluene | 40 |

Photoreceptor Production Example 21

The procedures for preparing the photoreceptor in Photoreceptor Production Example 8 were repeated except for changing the CTL coating liquid to a CTL coating liquid having the following components to provide a photoreceptor.

| CTL coating liquid | |
|---|---|
| Polycarbonate (TS2050 from Teijin Chemicals Ltd.) | 10 |
| CTM having the following formula | 7 |

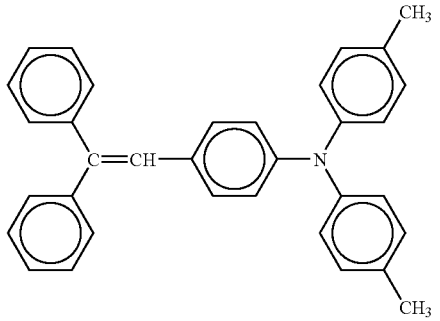

| | |
|---|---|
| Tetrahydrofuran | 80 |

Photoreceptor Production Example 22

The procedures for preparing the photoreceptor in Photoreceptor Production Example 9 were repeated except for changing the CTL coating liquid to a CTL coating liquid having the following components to provide a photoreceptor.

| CTL coating liquid | |
|---|---|
| Polycarbonate (TS2050 from Teijin Chemicals Ltd.) | 10 |
| CTM having the following formula | 7 |

-continued

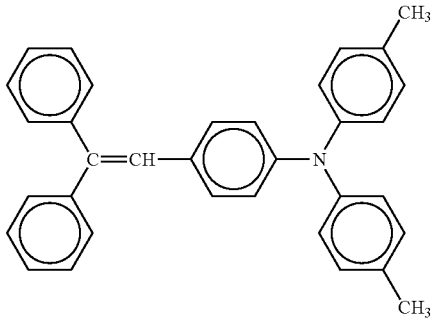

| | |
|---|---|
| Tetrahydrofuran | 80 |

Examples 26 to 30 and Comparative Example 24

The thus prepared electrophotographic photoreceptors in Photoreceptor Production Examples 13 to 16 were installed in the electrophotographic image forming apparatus in FIG. 1 as it was in Example 1, which uses a LD having a wavelength of 780 nm as an imagewise light irradiator (with a polygon mirror) and a contact charging roller as a charger, and halftone line images were produced in the following charging and transfer conditions to evaluate them. The transfer current was controlled with the circuit as shown in FIG. 12. The results are shown in Table 6 together with Example 1 and Comparative Example 5.

DC bias: −900 V

AC bias: 2.0 kV (peak to peak)

Frequency: 1.5 kHz

Transfer conditions: 110 μA

TABLE 6

| | Photoreceptor | Pigment | Image evaluation |
|---|---|---|---|
| Ex. 1 | Prod. Ex. 1 | Syn. Ex. 1 | Good |
| Ex. 26 | Prod. Ex. 17 | Syn. Ex. 1 | Good |
| Ex. 27 | Prod. Ex. 19 | Syn. Ex. 1 | Good |
| Ex. 28 | Prod. Ex. 20 | Syn. Ex. 1 | Good |
| Ex. 29 | Prod. Ex. 21 | Syn. Ex. 8 | Very good |
| Ex. 30 | Prod. Ex. 22 | Syn. Ex. 1 | Very good |
| Com. Ex. 5 | Prod. Ex. 6 | Syn. Ex. 6 | Image density deteriorated |
| Com. Ex. 24 | Prod. Ex. 18 | Syn. Ex. 6 | Image density deteriorated |

Photoreceptor Production Example 23

The procedures for preparing the photoreceptor in Photoreceptor Production Example 1 were repeated except for changing a diameter of the aluminium cylinder to 30 mm to provide a photoreceptor.

Photoreceptor Production Example 24

The procedures for preparing the photoreceptor in Photoreceptor Production Example 4 were repeated except for changing a diameter of the aluminium cylinder to 30 mm to provide a photoreceptor.

Photoreceptor Production Example 25

The procedures for preparing the photoreceptor in Photoreceptor Production Example 5 were repeated except for changing a diameter of the aluminium cylinder to 30 mm to provide a photoreceptor.

DC bias: −800 V

AC bias: 1.5 kV (peak to peak)

Frequency: 2.0 kHz

Charging member: The same charger used in Example 2

Irradiator: Polygon mirror using a laser diode having a wavelength of 780 nm Transfer conditions: 75 μA and 60 μA

TABLE 7

| | | | Transfer | Image | | |
|---|---|---|---|---|---|---|
| | PhotoReceptor | Pigment | current (μA) | Hollow image | Background fouling | Halftone |
| Ex. 31 | Prod. Ex. 23 | Syn. Ex. 1 | 75 | ○ | ○ | Good |
| Com. Ex. 25 | Prod. Ex. 24 | Syn. Ex. 4 | 75 | ○ | X | Color reproducibility deteriorated |
| Com. Ex. 26 | Prod. Ex. 25 | Syn. Ex. 5 | 75 | ○ | X | Color reproducibility deteriorated |
| Ex. 32 | Prod. Ex. 26 | Syn. Ex. 8 | 75 | ○ | ⊙ | Good |
| Ex. 33 | Prod. Ex. 27 | Syn. Ex. 1 | 75 | ○ | ⊙ | Good |
| Com. Ex. 27 | Prod. Ex. 23 | Syn. Ex. 1 | 60 | X | ○ | Good |
| Com. Ex. 28 | Prod. Ex. 24 | Syn. Ex. 4 | 60 | X | Δ | Color reproducibility deteriorated |
| Com. Ex. 29 | Prod. Ex. 25 | Syn. Ex. 5 | 60 | X | X | Color reproducibility deteriorated |
| Com. Ex. 30 | Prod. Ex. 26 | Syn. Ex. 8 | 60 | X | ⊙ | Good |
| Com. Ex. 31 | Prod. Ex. 27 | Syn. Ex. 1 | 60 | X | ⊙ | Good |

Photoreceptor Production Example 26

The procedures for preparing the photoreceptor in Photoreceptor Production Example 8 were repeated except for changing a diameter of the aluminium cylinder to 30 mm to provide a photoreceptor.

Photoreceptor Production Example 27

The procedures for preparing the photoreceptor in Photoreceptor Production Example 9 were repeated except for changing a diameter of the aluminium cylinder to 30 mm to provide a photoreceptor.

Example 31 to 33 and Comparative Examples 25 to 31

The thus prepared electrophotographic photoreceptors in Photoreceptor Production Examples 23 to 27 were installed in a process cartridge for electrophotographic apparatus together with a charging member, and the process cartridge was further installed in the full-color electrophotographic image forming apparatus in FIG. 4. Full-color 200,000 images were continuously produced to evaluate hollow images, background fouling and half tone images thereof in the following process conditions under an environment of 22° C. and 55% RH. The transfer current was controlled with the circuit as shown in FIG. 12. The evaluation was classified to four grades, i.e., ⊙ represents very good, O represents good, Δ represents slightly poor and x represents very poor. The results are shown in Table 7.

Finally, whether the minimum diffraction peak at a lowest Bragg (2θ) angle of 7.3° of the titanylphthalocyanine crystal of the present invention is different from peaks at 7.5° of known materials will be verified.

Synthesis Example 9

The procedures for preparing the titanylphthalocyanine crystal in Synthesis Example 1 were repeated to provide titanylphthalocyanine crystals except that the crystal conversion solvent was changed from methylene chloride to 2-butanone.

Figure 8:
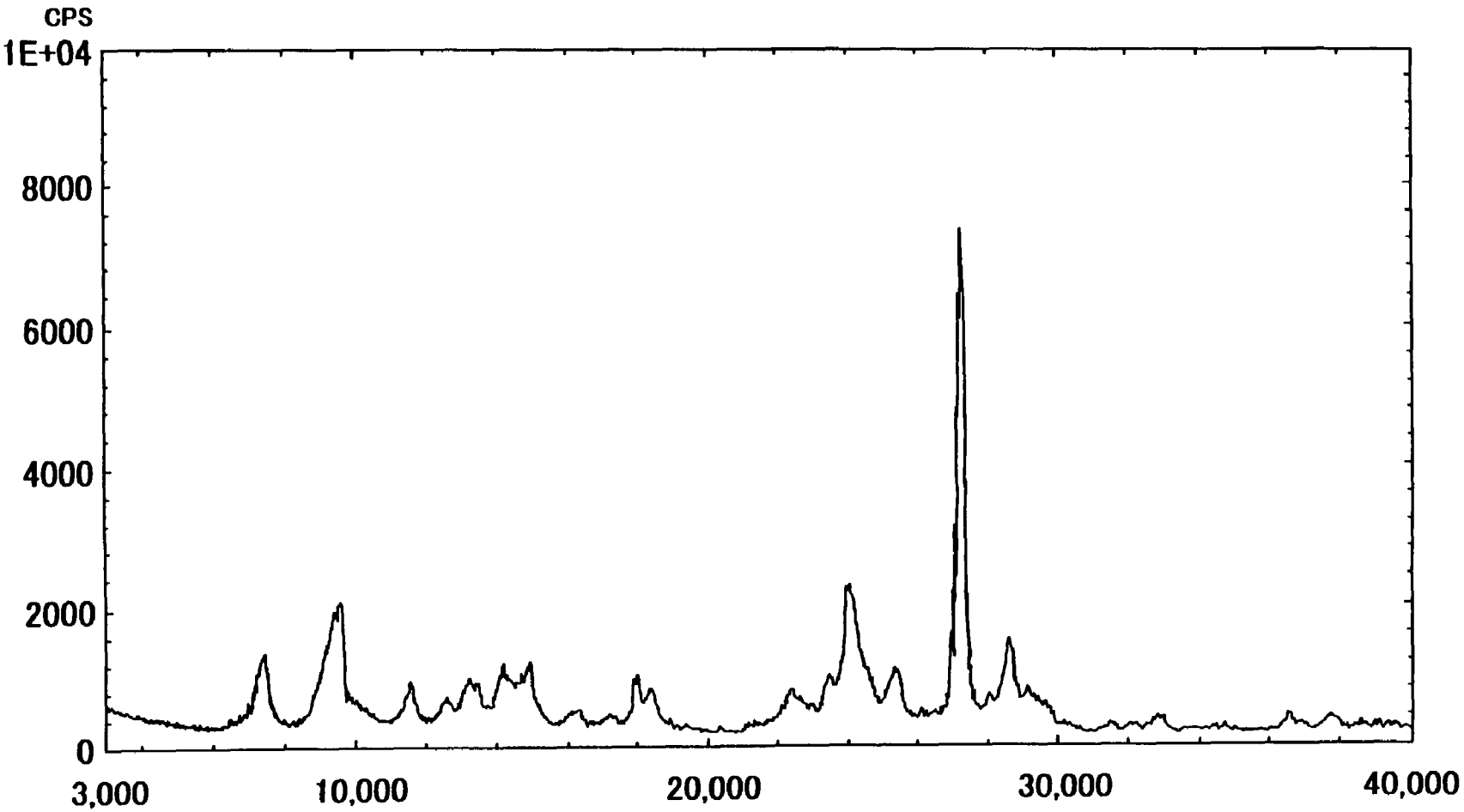
FIG. 8 is a diagram showing an X-ray spectrum of the titanylphthalocyanine crystal prepared in Synthesis Example 8.

A XD-spectrum of the titanylphthalocyanine crystals was measured as it was in Synthesis Example 1, and is shown in FIG. 8. FIG. 8 shows that the minimum diffraction peak in the XD-spectrum of the titanylphthalocyanine crystals is present at 7.5°, which is different from that (7.3°) of the titanylphthalocyanine crystals prepared in Synthesis Example 1.

Measurement Example 1

Three % by weight of a pigment prepared by the method disclosed in Japanese Laid-Open Patent Publication No. 61-239248 (having a maximum dif fraction peak at 7.5°) was included in the pigment prepared in Synthesis Example 1 (having a minimum diffraction peak at 7.3°). The mixture was mixed in a mortar and an X-ray spectrum thereof was measured. The results are shown in FIG. 9.

Measurement Example 2

Figure 10:
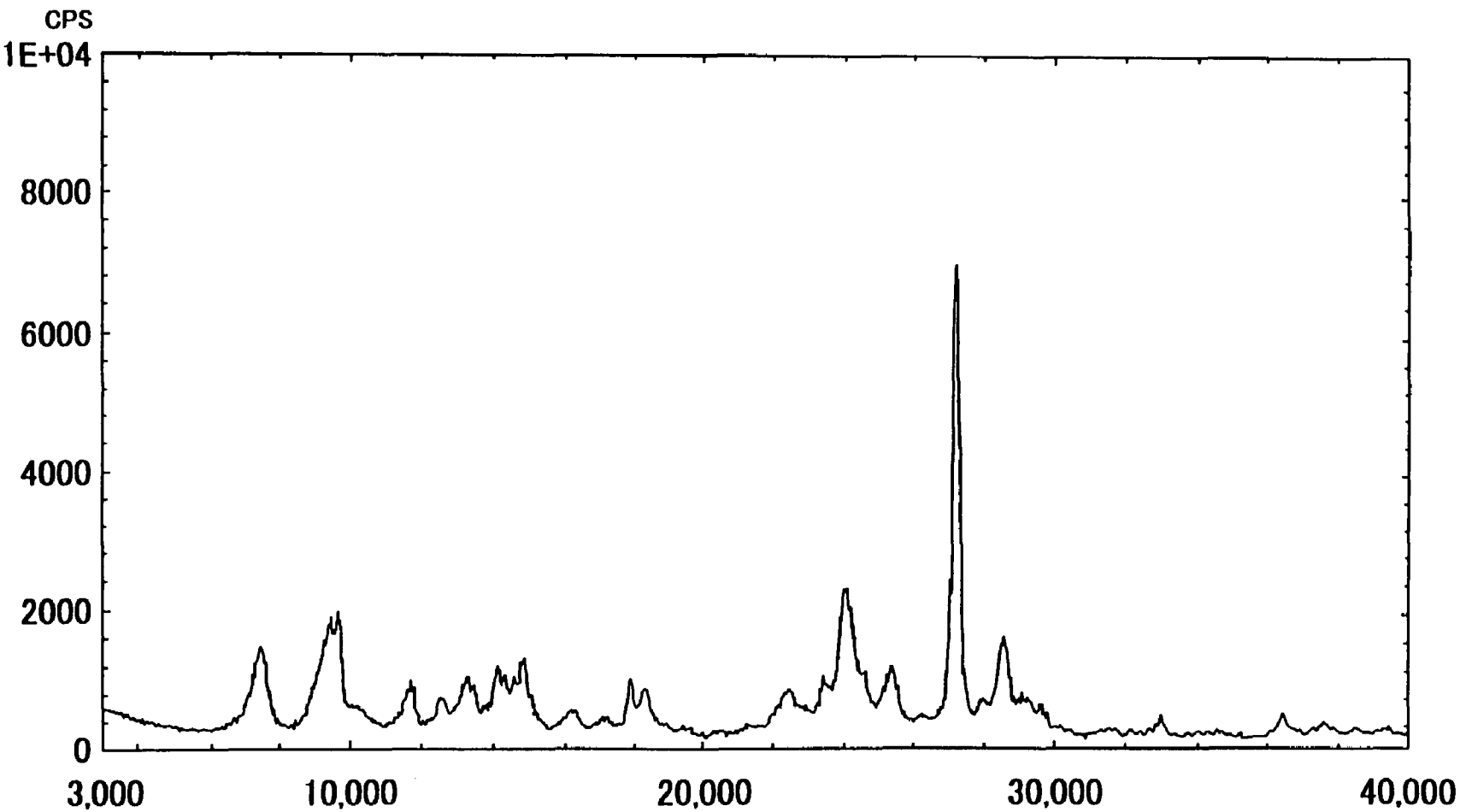
FIG. 10 is a diagram showing an X-ray spectrum of the titanylphthalocyanine crystal prepared in Measurement Example 2.
Figure 11:
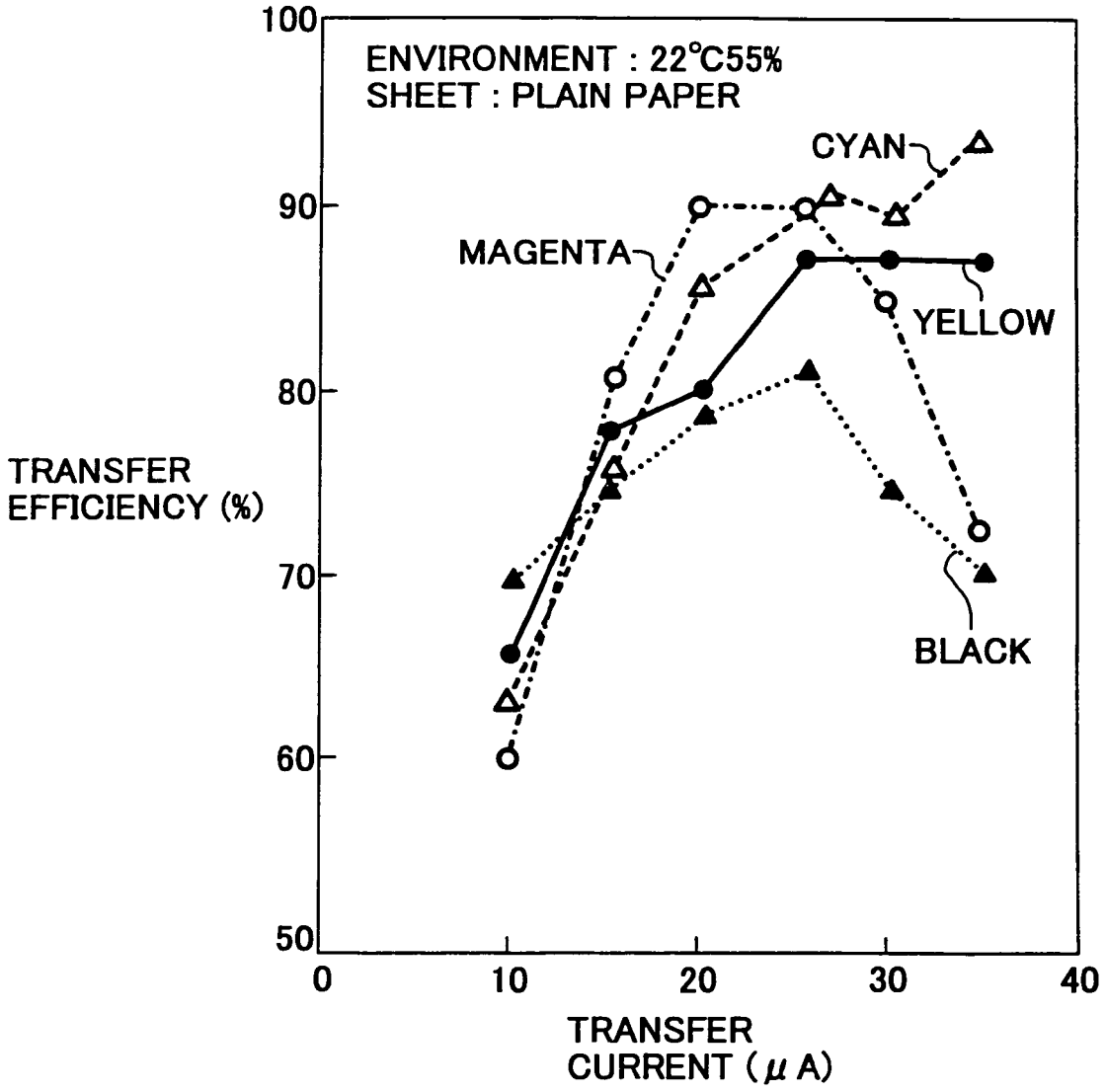
FIG. 11 is a diagram showing a relationship between transfer current and transfer efficiency.

Three % by weight of a pigment prepared by the method disclosed in Japanese Laid-Open Patent Publication No. 61-239248 (having a maximum diffraction peak at 7.5°) was included in the pigment prepared in Synthesis Example 8 (having a minimum diffraction peak at 7.5°). The mixture was mixed in a mortar and an X-ray spectrum thereof was measured. The results are shown in FIG. 10.

Figure 9:
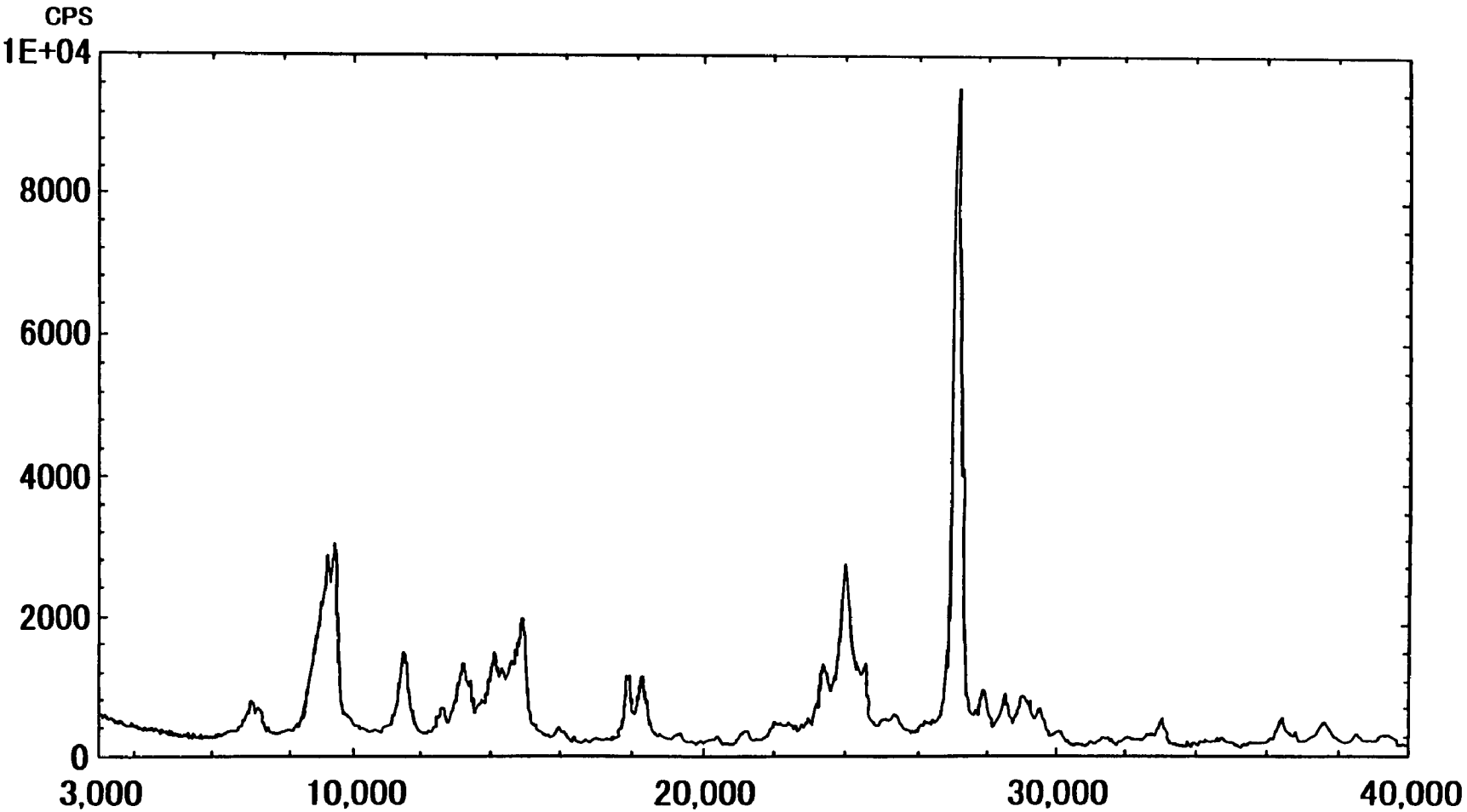
FIG. 9 is a diagram showing an X-ray spectrum of the titanylphthalocyanine crystal prepared in Measurement Example 1.

The spectrum in FIG. 9 has two independent peaks at low angles of 7.3 and 7.5°, and they are different from each other. The spectrum in FIG. 13 has only one peak at a low angle of 7.5°, and is apparently different from the spectrum in FIG. 9. Consequently, the minimum diffraction peak at a lowest Bragg (2θ) angle of 7.3° of the titanylphthalocyanine crystal of the present invention is different from peaks at 7.5° of known titanylphthalocyanine crystals.

This document claims priority and contains subject matter related to Japanese Patent Application No. 2002-274473 filed on Sep. 20, 2002, incorporated herein by reference. Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method, comprising:

charging an electrophotographic photoreceptor;

irradiating the electrophotographic photoreceptor to form an electrostatic latent image thereon;

developing the electrostatic latent image with a toner to form a toner image thereon; and transferring the toner image onto a transfer sheet while applying an electric current not less than 65 μA to the electrophotographic photoreceptor, and controlling the electric current with a constant current controller, wherein the electrophotographic photoreceptor comprises:

an electroconductive substrate;

a charge generation layer disposed over the electroconductive substrate; and a charge transport layer disposed over the charge generation layer, wherein the charge generation layer comprises a titanylphthalocyanine crystal in the form of particles having an average primary particle diameter of 0.3 μm or less and having a CuKα 1.542 Å X-ray diffraction spectrum comprising plural diffraction peaks, wherein a maximum diffraction peak is observed at a Bragg (2θ) angle of 27.2°; main peaks are observed at 9.4°, 9.6° and 24.0°; and a minimum diffraction peak is observed at 7.3°; and no diffraction peak is observed at an angle greater than 7.3° and less than 9.4°, wherein said angles may vary by ±0.2° and the minimum interval where no peak is observed between required peaks at 7.3 and 9.4 is 2.0 degrees absolute or more, and wherein the charge transport layer is disposed on the charge generation layer by applying a solution of a charge transport material in a non-halide solvent on the charge generation layer.

2. The image forming method of claim 1, further comprising:

returning a by-pass current flow in the transferring to an electrical source.

3. The image forming method of claim 1, further comprising:

controlling the transfer current by measuring a difference between a current measured thereby and an output from an electric source.

4. The image forming method of claim 1, wherein no defraction peak is observed at 26.3° in the x-ray defraction spectrum of the titanylphthalocyanine crystal.

5. The image forming method of claim 1, wherein the charging is carried out by contacting the electrophotographic photoreceptor with a charger.

6. The image forming method of claim 1, wherein the charging includes applying a DC voltage overlapped with an AC voltage to the electrophotographic photoreceptor.

7. The image forming method of claim 1, wherein the charge generation layer is coated with a dispersion liquid comprising the titanylphthalocyanine crystal, and the titanylphthalocyanine crystal has a volume-average particle diameter not greater than 0.3 μm, and wherein the dispersion liquid is dispersed until a standard deviation of the volume-average particle diameter becomes not greater than 0.2 μm and the dispersion liquid is then filtered with a filter having an effective poor diameter of not greater than 3 μm.

8. The image forming method of claim 1, wherein the charge transport layer comprises a polycarbonate having a triarylamine structure in at least one of the main chain and the side chain.

9. The image forming method of claim 1, wherein the electrophotographic photoreceptor further comprises a protection layer disposed over the charge transport layer.

10. The image forming method according to claim 1, wherein the titanylphthalocyanine crystals are in the form of particles having an average primary particle diameter of not greater than 0.2 μm.

* * * * *